US011429040B2

(12) United States Patent
Tajima et al.

(10) Patent No.: US 11,429,040 B2
(45) Date of Patent: Aug. 30, 2022

(54) IMAGE FORMING APPARATUS HAVING TRANSFER POSITION CHANGING MECHANISM

(71) Applicant: CANON KABUSHIKI KAISHA, Tokyo (JP)

(72) Inventors: Hirotoshi Tajima, Tokyo (JP); Kentaro Yamana, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/391,372

(22) Filed: Aug. 2, 2021

(65) Prior Publication Data

US 2021/0356886 A1 Nov. 18, 2021

Related U.S. Application Data

(63) Continuation of application No. PCT/JP2020/007143, filed on Feb. 21, 2020.

(30) Foreign Application Priority Data

Feb. 21, 2019 (JP) ..... JP2019-029157
Jan. 22, 2020 (JP) ..... JP2020-008788

(51) Int. Cl.
*G03G 15/01* (2006.01)
*G03G 15/16* (2006.01)
*G03G 15/00* (2006.01)

(52) U.S. Cl.
CPC ..... *G03G 15/1615* (2013.01); *G03G 15/0189* (2013.01); *G03G 15/6594* (2013.01);
(Continued)

(58) Field of Classification Search
CPC ..... G03G 15/1615; G03G 15/6594; G03G 15/0136; G03G 15/0189;
(Continued)

(56) References Cited

U.S. PATENT DOCUMENTS 9,772,584 B2 * 9/2017 Aiba ..... G03G 15/1615
11,029,626 B2 * 6/2021 Torimaru ..... G03G 15/1615
(Continued)

FOREIGN PATENT DOCUMENTS

CN 103558745 A 2/2014
CN 106227010 A 12/2016
(Continued)

OTHER PUBLICATIONS

International Search Report issued in Intl. Appln. No. PCT/JP2020/007143 dated Apr. 7, 2020. English translation provided.
(Continued)

*Primary Examiner* — Robert B Beatty
(74) *Attorney, Agent, or Firm* — Rossi, Kimms & McDowell LLP

(57) ABSTRACT

A rotation center of a secondary transfer inner roller located at a first position is located downstream of a rotation center of a secondary transfer outer roller in a movement direction of an intermediate transfer belt tensioned by the secondary transfer inner roller and an idler roller. The rotation center of the secondary transfer inner roller located at a second position coincides in position with the rotation center of the secondary transfer outer roller, or is located upstream of the rotation center of the secondary transfer outer roller in the movement direction of the intermediate transfer belt tensioned by the secondary transfer inner roller and the idler roller.

22 Claims, 25 Drawing Sheets

(52) U.S. Cl.
CPC ..... *G03G 15/1675* (2013.01); *G03G 2215/00481* (2013.01); *G03G 2215/0122* (2013.01)

(58) Field of Classification Search
CPC ..... G03G 2215/00481; G03G 2215/00485; G03G 2215/0122; G03G 2215/0125; G03G 2215/0129; G03G 2215/1623
USPC ..... 399/66, 302
See application file for complete search history.

(56) References Cited

U.S. PATENT DOCUMENTS

2008/0019717 A1* 1/2008 Soshiroda ..... G03G 15/161 399/45
2009/0257764 A1 10/2009 Okamoto
2011/0026954 A1* 2/2011 Kishi ..... G03G 15/1695 399/45
2011/0064465 A1 3/2011 Kaseda
2011/0188891 A1* 8/2011 Ryu ..... G03G 15/16 399/121
2013/0315612 A1 11/2013 Nishisaka
2014/0199089 A1* 7/2014 Ishikawa ..... G03G 15/6558 399/45
2014/0294408 A1 10/2014 Yoshioka
2014/0294411 A1 10/2014 Yoshioka
2015/0220027 A1* 8/2015 Yoshioka ..... G03G 15/1695 399/66
2016/0357129 A1 12/2016 Kakehi
2020/0310306 A1* 10/2020 Yamana ..... G03G 15/1615

FOREIGN PATENT DOCUMENTS

EP 3101482 A1 12/2016
JP 2007010742 A * 1/2007
JP 2009251558 A 10/2009
JP 2011064917 A 3/2011
JP 2013122475 A 6/2013
JP 2013246253 A 12/2013
JP 2014134614 A 7/2014
JP 2014191098 A 10/2014
JP 2014191100 A 10/2014
JP 2016031471 A 3/2016
JP 2016224403 A 12/2016
JP 2020134739 A * 8/2020

OTHER PUBLICATIONS

Written Opinion issued in Intl. Appln. No. PCT/JP2020/007143 dated Apr. 7, 2020.

* cited by examiner

*FIG 7*

| | FIRST POSITION | SECOND POSITION |
|---|---|---|
| BASIS WEIGHT OF RECORDING MATERIAL | LESS THAN 52 gsm | 52 gsm OR MORE |
| SENSOR 22 | ON | OFF |
| CAM 15c | LARGE DIAMETER PORTION 15c1 | SMALL DIAMETER PORTION 15c2 |

IMAGE FORMING APPARATUS HAVING TRANSFER POSITION CHANGING MECHANISM

CROSS-REFERENCE TO RELATED APPLICATIONS

This application is a Continuation of International Patent Application No. PCT/JP2020/007143, filed Feb. 21, 2020, which claims the benefit of Japanese Patent Application No. 2019-029157, filed Feb. 21, 2019, and Japanese Patent Application No. 2020-008788, filed Jan. 22, 2020, both of which are hereby incorporated by reference herein in their entirety.

BACKGROUND OF THE INVENTION

Field of the Invention

The present invention relates to an image forming apparatus adopting an intermediate transfer system.

Description of the Related Art

In the related art, an image forming apparatus is well known which transfers a toner image, which is formed on a surface of a photosensitive drum, on to a recording material such as paper via an intermediate transfer belt.

In the related art, in order to improve the separability of the recording material from the intermediate transfer belt, in many cases, a secondary transfer outer roller is disposed upstream of a secondary transfer inner roller in a conveyance direction of the recording material, and the angle between the conveyance direction of the recording material immediately after the recording material has passed through a secondary transfer nip portion and the intermediate transfer belt is increased.

However, a case is taken into consideration in which when the recording material is thick, the secondary transfer outer roller is located upstream of the secondary transfer inner roller in the conveyance direction of the recording material. Then, a conveyance path of the recording material from a registration roller to the secondary transfer nip portion is bent, so that conveyance resistance of the recording material increases, the registration roller being disposed upstream of the secondary transfer nip portion in the conveyance direction of the recording material and also serving to convey the recording material.

As a result, there occurs a velocity difference between the conveyance velocity of a middle portion of the recording material being conveyed by the registration roller and the conveyance velocity of a rear end portion of the recording material after the recording material has been extracted from the registration roller. Accordingly, there is a probability that horizontal stripes are generated due to transfer shift or transfer defects occur due to the jumping up of the rear end portion of the recording material after the recording material has been extracted from the registration roller.

For this reason, the bending of the conveyance path of the recording material from the registration roller to the secondary transfer nip portion has to be reduced. For this reason, when the paper thickness of the recording material is large, it is necessary to dispose the position of the secondary transfer outer roller further on a downstream side in the conveyance direction of the recording material, and reduce further conveyance resistance of the recording material than when the paper thickness of the recording material is small. For this reason, it is necessary to change the position of the secondary transfer nip portion according to the paper thickness of the recording material.

In order to solve the above problem, in Japanese Patent Laid-Open No. 2009-251558, a transfer roller displacement driving portion is provided which displaces the position of the secondary transfer outer roller to at least a first position and a second position with respect to the secondary transfer inner roller as a turning reference.

In addition, in Japanese Patent Laid-Open No. 2014-191100, the projection angle of the intermediate transfer belt before and after the secondary transfer nip portion is changed according to the paper thickness of the recording material to change the shape of the secondary transfer nip.

However, in the case of the configuration of Japanese Patent Laid-Open No. 2009-251558 or Japanese Patent Laid-Open No. 2014-191100, an improvement in transferability for each of a plurality of types of recording materials that are different in stiffness may not be sufficient.

The present invention solves the above problems, and an object of the present invention is to provide an image forming apparatus capable of improving transferability for each of a plurality of types of recording materials that are different in stiffness.

SUMMARY OF THE INVENTION

According to a representative configuration of the present invention in order to achieve the above object, there is provided an image forming apparatus including: a rotatable endless belt configured to convey a toner image; a plurality of tension rollers configured to tension the belt, and including an inner roller and an upstream roller that is disposed adjacent to the inner roller on an upstream side of the inner roller with respect to a rotational direction of the belt; an outer roller contacting an outer peripheral surface of the belt and configured to form a transfer portion, where the toner image is transferred from the belt onto a recording material, by nipping said intermediary transfer belt between itself and the inner roller; a position changing mechanism configured to change a position of the inner roller, and change a position of the transfer portion; and a controller configured to control the position changing mechanism. In a cross section substantially orthogonal to a rotational axis direction of the inner roller, a common tangent line of the inner roller and the upstream roller on a side on which the belt is suspended is defined as a reference line L1, a straight line passing through a rotation center of the inner roller and being substantially orthogonal to the reference line L1 is defined as an inner roller center line L2, a straight line passing through a rotation center of the outer roller and being substantially orthogonal to the reference line L1 is defined as an outer roller center line L3, and a distance between the inner roller center line L2 and the outer roller center line L3 is defined as an offset amount X (here, a positive value when the outer roller center line L3 is located upstream of the inner roller center line L2 in the rotational direction of the belt), the controller controls the position changing mechanism to set a position at which the offset amount X has a positive value in the case of a first recording material, and controls the position changing mechanism to set a position at which the offset amount X has a negative value in the case of a second recording material having a thickness larger than a thickness of the first recording material.

According to the present invention, transferability for each of a plurality of types of recording materials that are different in stiffness is improved.

Further features of the present invention will become apparent from the following description of exemplary embodiments with reference to the attached drawings.

BRIEF DESCRIPTION OF THE DRAWINGS

FIG. 7 is a table describing switching conditions for switching the secondary transfer inner roller between the first position and the second position.

DESCRIPTION OF THE EMBODIMENTS

First Embodiment

One embodiment of an image forming apparatus according to the present invention will be specifically described with reference to the drawings.

<Image Forming Apparatus>

Figure 1:
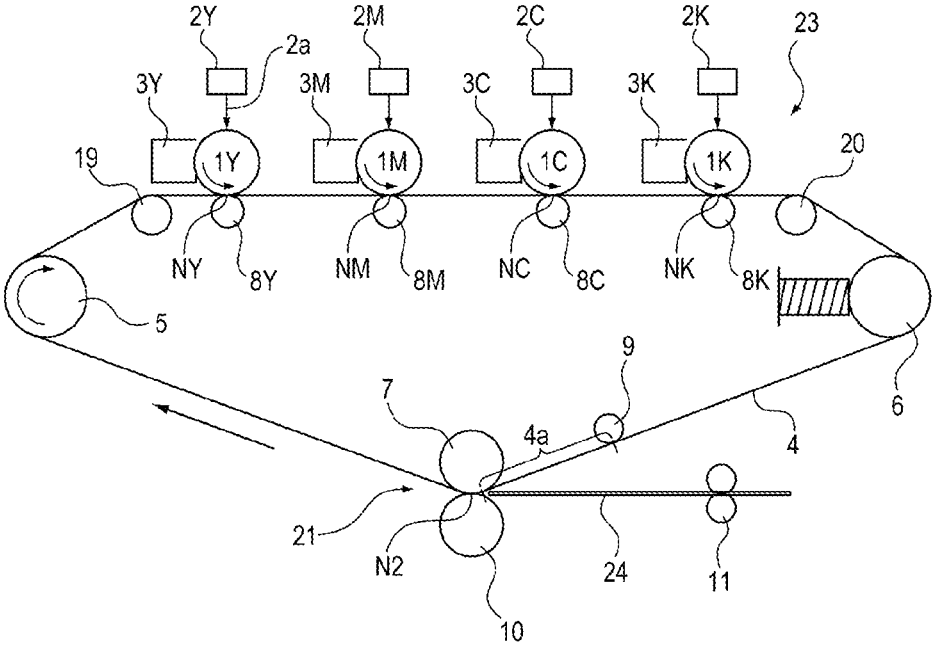
FIG. 1 is a cross-sectional view illustrating a configuration of an image forming apparatus.

FIG. 1 is a cross-sectional view illustrating a configuration of an image forming apparatus 23. The image forming apparatus 23 illustrated in FIG. 1 is one example of a color digital copying machine adopting an electrophotographic system and an intermediate transfer system. As long as the image forming apparatus 23 includes a secondary transfer portion 21 configured to transfer secondarily a developer image onto a recording material 24 such as paper, the present invention is applicable to various image forming apparatuses.

The image forming apparatus 23 illustrated in FIG. 1 illustrates a configuration of each transfer portion in a full color mode. The image forming apparatus 23 includes photosensitive drums 1Y, 1M, 1C, and 1K as image bearing members for yellow color Y, magenta color M, cyan color C, and black color K. Incidentally, for convenience of explanation, each of the photosensitive drums 1Y, 1M, 1C, and 1K may be described using a photosensitive drum 1. The same applies to other image forming process portions.

Each of the photosensitive drums 1 is rotationally driven at a predetermined process speed in a counterclockwise direction of FIG. 1 by a driving mechanism not illustrated. When each of the photosensitive drums 1 rotates in the counterclockwise direction in FIG. 1, a surface of each of the photosensitive drums 1 is uniformly charged by a charging portion not illustrated which is provided around each of the photosensitive drums 1. The uniformly charged surface of each of the photosensitive drums 1 is irradiated with laser light 2*a* from each scanner unit 2 as an exposure portion based on image information. Accordingly, an electrostatic latent image is formed on the surface of each of the photosensitive drums 1.

A toner of each color from each development apparatus 3 as a development portion adheres to the electrostatic image formed on the surface of the corresponding photosensitive drums 1, and the electrostatic image is formed as a toner image. Primary transfer nip portions NY, NM, NC, and NK are formed between an intermediate transfer belt 4 and the respective photosensitive drums 1. In each of the primary transfer nip portions NY, NM, NC, and NK, a primary transfer bias is applied to a primary transfer roller 8 as a primary transfer member from a primary transfer power supply not illustrated. Accordingly, the toner images formed on the surfaces of the photosensitive drums 1 are primarily transferred on to and superimposed on top of another on an outer peripheral surface of the intermediate transfer belt 4 in contact with each of the photosensitive drums 1.

<Intermediate Transfer Belt>

The intermediate transfer belt 4 conveys the toner image as a developer image which has been transferred by each of the primary transfer rollers 8 as primary transfer members. The intermediate transfer belt 4 is an endless belt in which a base layer is made of polyimide as a material and a surface layer of the base layer is coated with a conductive type rubber. At least the surface layer of the intermediate transfer belt 4 is made of an elastic rubber.

The intermediate transfer belt 4 is rotatably tensioned by a driving roller 5, a tension roller 6, a secondary transfer inner roller 7, each of the primary transfer rollers 8, an idler roller 9, and driven rollers 19 and 20. The secondary transfer inner roller 7 as a counter member is disposed on an inner peripheral surface side of the intermediate transfer belt 4. The idler roller 9 is disposed on the inner peripheral surface side of the intermediate transfer belt 4. The idler roller 9 is disposed upstream of the secondary transfer inner roller 7 in a rotational direction of the intermediate transfer belt 4. The driving roller 5 is rotated in a clockwise direction of FIG. 1 by a driving mechanism not illustrated. Accordingly, the intermediate transfer belt 4 rotates in the clockwise direction of FIG. 1.

A secondary transfer outer roller 10 as a secondary transfer roller is disposed at a position at which the secondary transfer outer roller 10 faces the secondary transfer inner roller 7 as a counter member with the intermediate transfer belt 4 interposed therebetween. The secondary transfer outer roller 10 forms a secondary transfer nip portion N2 between an outer peripheral surface of the intermediate transfer belt 4 and the secondary transfer outer roller 10. The toner images that have been transferred on to the outer peripheral surface of the intermediate transfer belt 4 are conveyed to the secondary transfer nip portion N2.

Meanwhile, the recording material 24 such as paper which has been fed from a feeding portion not illustrated is conveyed at a predetermined timing by a registration roller 11 as a conveying portion configured to convey the recording material 24 to the secondary transfer nip portion N2. The registration roller 11 conveys the recording material 24 such that the recording material 24 reaches the secondary transfer nip portion N2 at the timing when an image tip of the toner images formed on the outer peripheral surface of the intermediate transfer belt 4 reaches the secondary transfer nip portion N2.

In the secondary transfer nip portion N2, a secondary transfer bias is applied to the secondary transfer outer roller 10 from a secondary transfer power supply not illustrated, so that the toner images formed on the outer peripheral surface of the intermediate transfer belt 4 are secondarily transferred on to the recording material 24. In the secondary transfer nip portion N2, the toner images that have been transferred on to the recording material 24 are thermally fixed by a fixing apparatus not illustrated, and are discharged by a discharge mechanism not illustrated.

<Peripheral Configuration of Secondary Transfer Portion>

Figure 2:
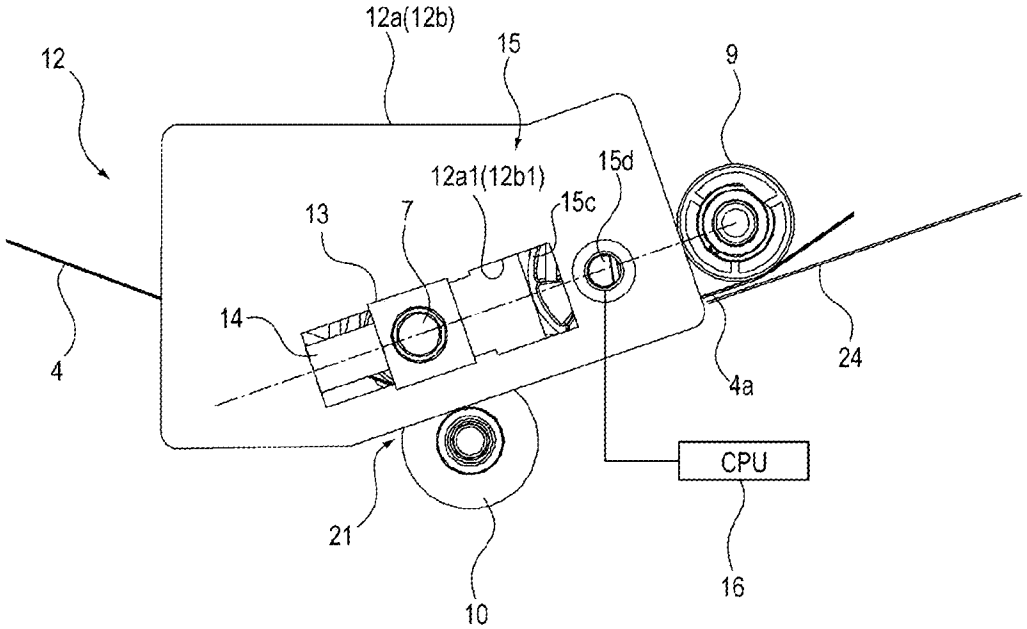
FIG. 2 is a cross-sectional view illustrating a peripheral configuration of a secondary transfer portion.

Next, a peripheral configuration of the secondary transfer portion 21 will be described with reference to FIG. 2. FIG. 2 is a cross-sectional view illustrating the peripheral configuration of the secondary transfer portion 21. The secondary transfer portion 21 illustrated in FIG. 2 includes the secondary transfer inner roller 7 that is one of tension members of the intermediate transfer belt 4, and the secondary transfer outer roller 10 which is disposed to face the secondary transfer inner roller 7 and is in contact with the outer peripheral surface of the intermediate transfer belt 4. The secondary transfer outer roller 10 nips and conveys the recording material 24 in cooperation with the intermediate transfer belt 4, and transfers the toner images on the outer peripheral surface of the intermediate transfer belt 4 on to the recording material 24.

Figure 8:
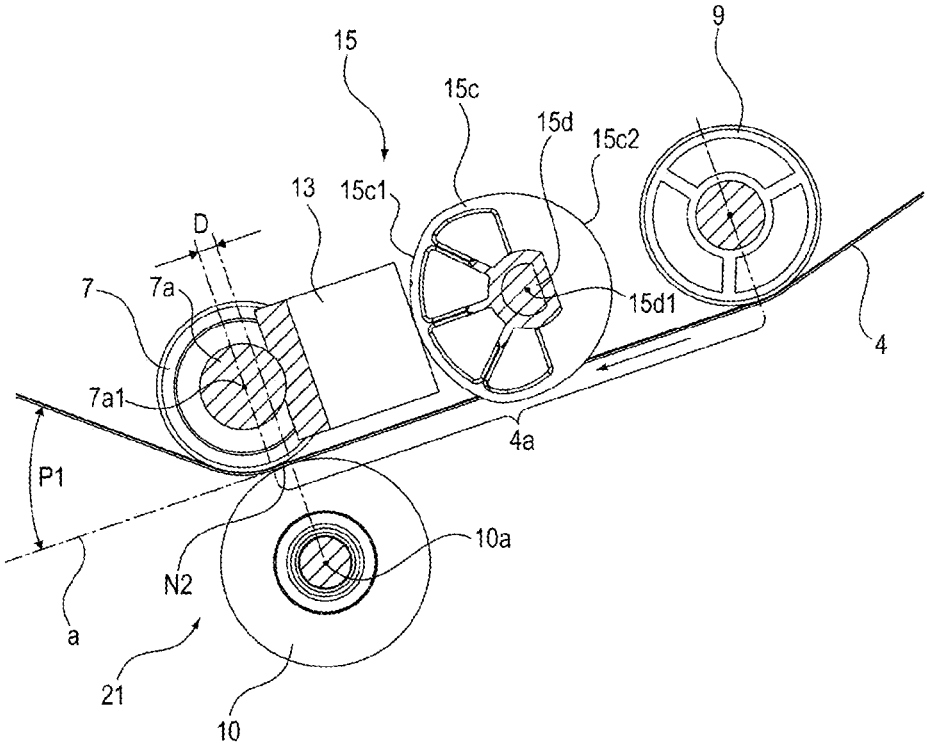
FIG. 8 is a cross-sectional view illustrating the state of the secondary transfer inner roller at the first position.
Figure 9:
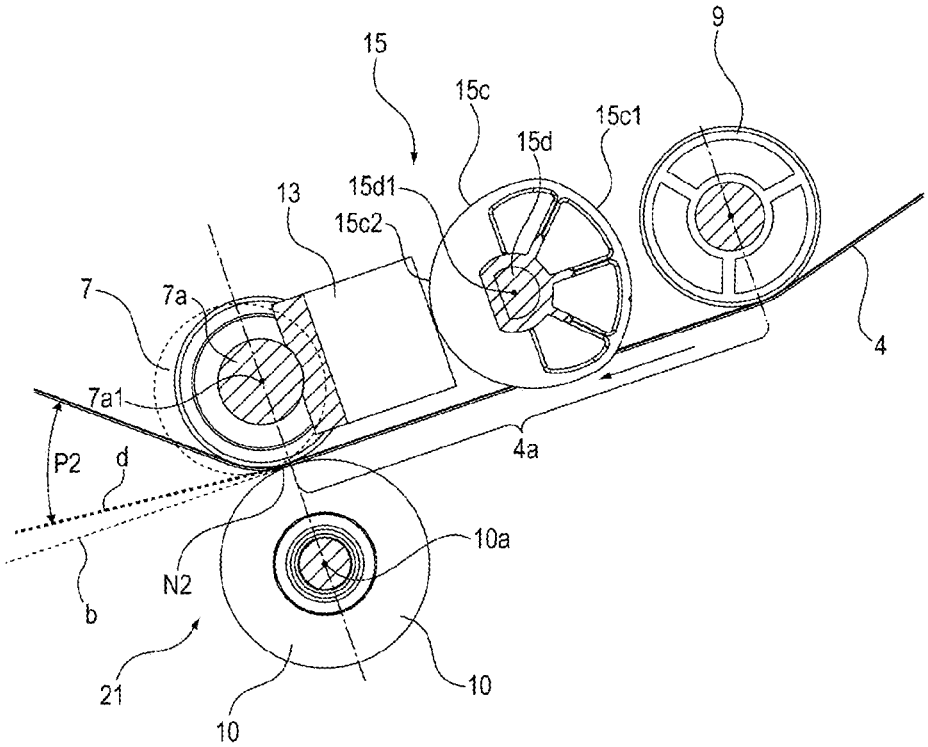
FIG. 9 is a cross-sectional view illustrating the state of the secondary transfer inner roller at the second position.

Further, the secondary transfer portion 21 includes a pressing member not illustrated and being configured to press the secondary transfer outer roller 10 against the intermediate transfer belt 4. Further, the secondary transfer portion 21 includes a housing 13 configured to rotatably support the secondary transfer inner roller 7 and, as illustrated in FIGS. 8 and 9, movably supports the secondary transfer inner roller 7, and a pressing member 14 that presses one end portion of the housing 13 as a bearing. The housing 13 is formed of a bearing configured to rotatably support a rotational shaft 7*a* of the secondary transfer inner roller 7 as a counter member.

Further, the secondary transfer portion 21 includes a roller displacement mechanism 15 configured to displace the position of the secondary transfer inner roller 7 with respect to the secondary transfer outer roller 10 at least to a first position illustrated in FIG. 8 and a second position illustrated in FIG. 9 which is different from the first position. Further, the secondary transfer portion 21 includes a roller unit 12 configured to support the secondary transfer inner roller 7, the housing 13, the pressing member 14, and the roller displacement mechanism 15. The image forming apparatus 23 is provided with a central processing unit (CPU) 16 including a control circuit as a controller configured to control driving of the roller displacement mechanism 15. A coil spring is adopted as the pressing member 14, but other pressing members may be adopted.

<Transfer Roller Displacement Mechanism>

Figure 3:
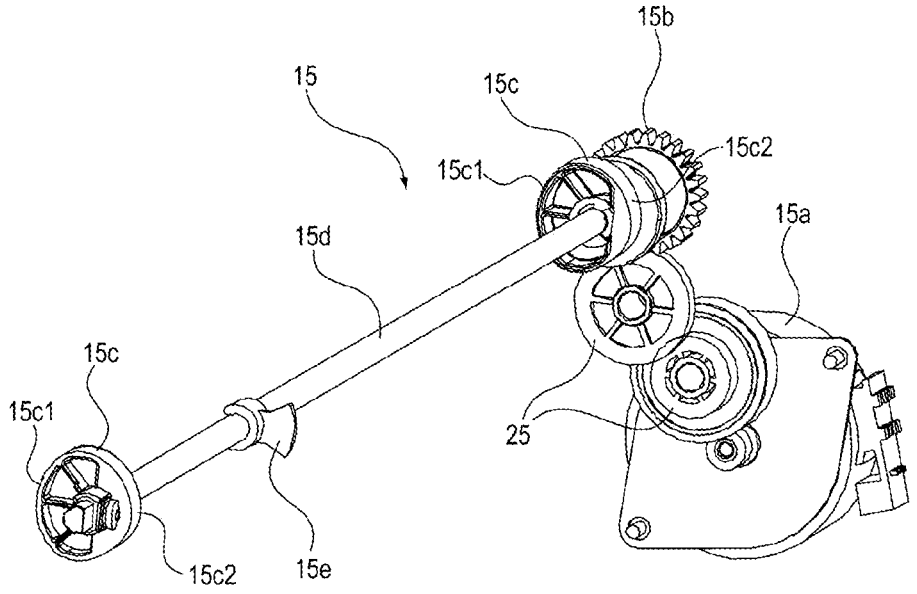
FIG. 3 is a perspective view illustrating a configuration of a roller displacement mechanism.

Next, a configuration of the roller displacement mechanism 15 will be described with reference to FIG. 3. FIG. 3 is a perspective view illustrating the configuration of the roller displacement mechanism 15. A cam 15*c* of the roller displacement mechanism 15 illustrated in FIG. 3 abuts against one end portion of the housing 13 as a bearing. Accordingly, the contact position of the secondary transfer inner roller 7 as a counter member, which is rotatably supported by the housing 13, with respect to the inner peripheral surface of the intermediate transfer belt 4 is displaced at least to the first position illustrated in FIG. 8 and the second position illustrated in FIG. 9.

The roller displacement mechanism 15 includes a gear 15*b* that receives a rotational driving force from a motor 15*a*, which is a driving source, via a drive transmission portion 25. Further, the roller displacement mechanism 15 includes a shaft 15*d* that is disposed coaxially with the cam 15*c*, the gear 15*b*, and the cam 15*c* in parallel to a rotational axis direction of the secondary transfer inner roller 7. Further, the roller displacement mechanism 15 includes a flag 15*e* provided in the shaft 15*d*. Incidentally, the gear 15*b*, the cam 15*c*, and the flag 15*e* are configured to be rotatable integrally and coaxially with the shaft 15*d*. The cam 15*c* abuts against the housing 13 as a bearing to displace the secondary transfer inner roller 7 as a counter member to the first position illustrated in FIG. 8 and the second position illustrated in FIG. 9.

As illustrated in FIG. 2, both end portions of the shaft 15*d* are rotatably supported by housings 12*a* and 12*b* that are provided on apparatus main body front and back sides of the roller unit 12, respectively. The roller unit 12 is provided with a sensor 22 illustrated in FIG. 5 and configured to detect the flag 15*e* illustrated in FIG. 3.

One end portion of the pressing member 14 illustrated in FIG. 2 is abutted against the housing 13 configured to movably support the secondary transfer inner roller 7. Meanwhile, the other end portion of the pressing member 14 is fitted into groove portions 12*a*1 and 12*b*1 that are provided in the housings 12*a* and 12*b* of the roller unit 12, respectively, and abuts against and supports wall surfaces of the groove portions 12*a*1 and 12*b*1.

The pressing member 14 presses the housing 13 as a bearing substantially in parallel to a tension surface 4*a* of the intermediate transfer belt 4 tensioned by the secondary transfer inner roller 7 as a counter member and the idler roller 9. The secondary transfer inner roller 7, the housing 13 as a bearing, the roller displacement mechanism 15, and the pressing member 14 are integrally supported by the roller unit 12 as a secondary transfer inner unit.

As illustrated in FIG. 2, the shape of the groove portions 12*a*1 and 12*b*1 that are provided in the housings 12*a* and 12*b* of the roller unit 12, respectively, is taken into consideration. At this time, the secondary transfer inner roller 7 and the tension surface 4*a* of the intermediate transfer belt 4 are taken into consideration, the intermediate transfer belt 4 being tensioned by the idler roller 9 installed at a position closest to the secondary transfer inner roller 7 with respect to an upstream side in a conveyance direction of the recording material 24. At this time, the shape of the groove portions 12*a*1 and 12*b*1 is a shape extending substantially parallel with respect to the tension surface 4*a*. The housing 13 is movable along the groove portions 12*a*1 and 12*b*1.

<Cam>

Figure 4:
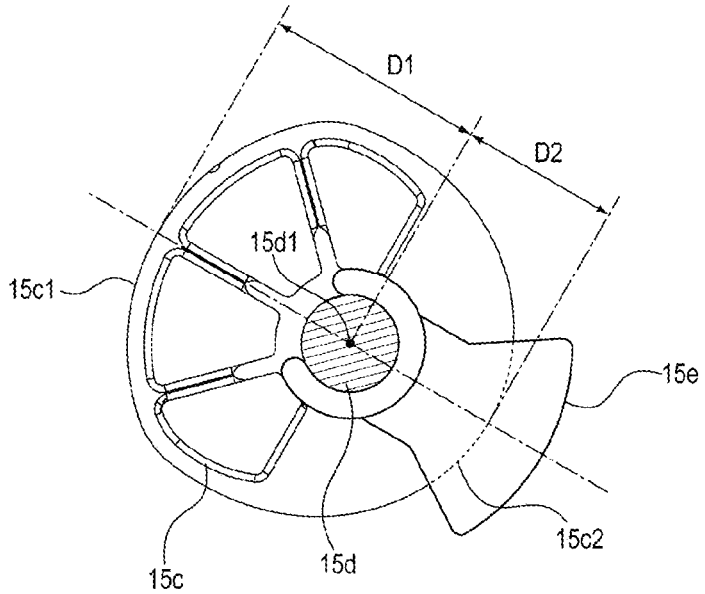
FIG. 4 is a cross-sectional view illustrating a configuration of a cam.

Next, a configuration of the cam 15*c* will be described with reference to FIG. 4. FIG. 4 is a cross-sectional view illustrating the configuration of the cam 15*c*. As illustrated in FIG. 4, the cam 15*c* is shaped such that a diameter D2 of a small diameter portion 15*c*2 having a rotation center 15*d*1 as a center is smaller by 2.5 mm than a diameter D1 of a large diameter portion 15*c*1 having the rotation center 15*d*1 as a center. Other portions have a shape connected by a smooth curve.

Regarding the phase relationship between the cam 15*c* and the flag 15*e* that rotate integrally with the shaft 15*d*, the center of the large diameter portion 15*c*1 of the cam 15*c* is provided at a position at which the large diameter portion 15*c*1 is rotated 180 degrees around the rotation center 15*d*1 of the shaft 15*d* with respect to the flag 15*e*. When the sensor 22 illustrated in FIG. 5 and configured to detect the flag 15*e* is turned on, as illustrated in FIG. 8, the large diameter portion 15*c*1 of the cam 15*c* is abutted against the housing 13. At this time, the position of the secondary transfer inner roller 7 is at the most downstream location of the movement range of the secondary transfer inner roller 7 in the rotational direction of the intermediate transfer belt 4.

<Controller>

Figure 5:
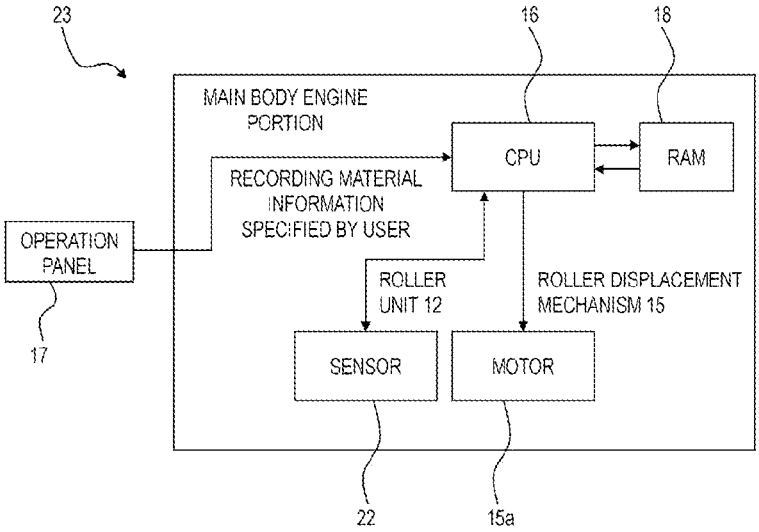
FIG. 5 is a block diagram illustrating a configuration of a controller.

Next, a configuration of a controller will be described with reference to FIG. 5. FIG. 5 is a block diagram illustrating the configuration of the controller. The CPU 16 as a controller controls driving of the motor 15*a*, which is a driving source of the roller displacement mechanism 15, according to information regarding the recording material 24 which is set by a user on an operation panel 17 as a condition setting portion provided in the image forming apparatus 23. The operation panel 17 is configured as a condition setting portion on which the information regarding the recording material 24 is set. Specifically, the CPU 16 illustrated in FIG. 5 temporarily stores the information regarding the recording material 24 in a random access memory (RAM) 18 as a storage portion, the information being input to the operation panel 17 provided in the image forming apparatus 23 by the user.

At the start of the print operation of the image forming apparatus 23, the CPU 16 controls driving of the motor 15*a* of the roller displacement mechanism 15 based on at least one of the information regarding the recording material 24 stored in the RAM 18 In this case, the information regarding the recording material 24 includes at least one of the basis weight of the recording material 24 and the thickness of the recording material 24. The CPU 16 uses at least one or more information regarding the recording material 24 described above when the CPU 16 controls the motor 15*a* of the roller displacement mechanism 15.

<Control Operation>

Figure 6:
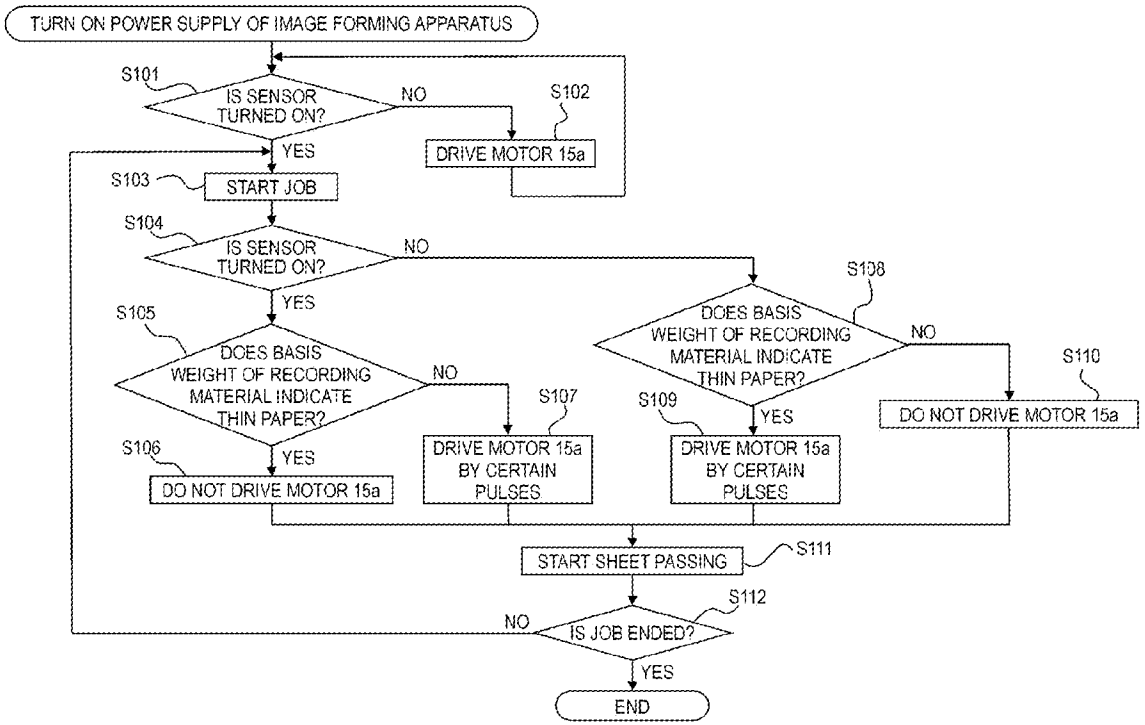
FIG. 6 is a flowchart describing a control operation of moving a secondary transfer inner roller to a first position and a second position.

Next, a control operation of moving the secondary transfer inner roller 7 to the first position illustrated in FIG. 8 and the second position illustrated in FIG. 9 will be described with reference to FIG. 6. FIG. 6 is a flowchart describing the control operation of moving the secondary transfer inner roller 7 to the first position illustrated in FIG. 8 and the second position illustrated in FIG. 9. The flowchart of FIG. 6 illustrates the control of driving the motor 15*a* of the roller displacement mechanism 15 from the initialization operation of the motor 15*a* of the roller displacement mechanism 15 according to the basis weight of the recording material 24 when a power supply of the image forming apparatus 23 is turned on.

In step S101 of FIG. 6, the CPU 16 determines whether or not the sensor 22 is turned on when the power supply of the image forming apparatus 23 is turned on. In step S101, when it is determined that the sensor 22 is not turned on, the process proceeds to step S102, and the CPU 16 causes the motor 15*a* of the roller displacement mechanism 15 to be rotationally driven until the sensor 22 is turned on.

In step S101, when it is determined that the sensor 22 is turned on, the process proceeds to step S103, and the CPU 16 starts a job that the user has input by operating the operation panel 17. Next, the process proceeds to step S104, and the CPU 16 determines whether or not the sensor 22 is turned on.

In step S104, when it is determined that the sensor 22 is turned on, the secondary transfer inner roller 7 is located at the first position illustrated in FIG. 8. Next, the process proceeds to step S105, and the CPU 16 determines whether or not the basis weight of the recording material 24 which the user has input in advance by operating the operation panel 17 indicates thin paper with reference to the information regarding the recording material 24 which is stored in the RAM 18.

In step S105, when it is determined that the basis weight of the recording material 24 passing through the secondary transfer nip portion N2 indicates thin paper, the process proceeds to step S106, and the CPU 16 maintains the state as it is without controlling the motor 15*a* of the roller displacement mechanism 15. At this time, the secondary transfer inner roller 7 is located at the first position illustrated in FIG. 8. At this time, the large diameter portion 15*c*1 of the cam 15*c* presses the housing 13 of the secondary transfer inner roller 7 downstream in the rotational direction of the intermediate transfer belt 4 in parallel to the tension surface 4*a* of the intermediate transfer belt 4 in FIG. 8 against the pressing force of the pressing member 14. Accordingly, the secondary transfer inner roller 7 also moves downstream in the rotational direction of the intermediate transfer belt 4 by a movement amount D integrally with the housing 13 and in parallel to the tension surface 4*a* of the intermediate transfer belt 4 in FIG. 8.

In step S105, when it is determined that the basis weight of the recording material 24 passing through the secondary transfer nip portion N2 indicates thick paper, the process proceeds to step S107. In step S107, the CPU 16 causes the motor 15*a* of the roller displacement mechanism 15 to operate rotationally by certain pulses, so that the cam 15*c* is rotated 180 degrees from the state illustrated in FIG. 8 to the state illustrated in FIG. 9.

At this time, the large diameter portion 15*c*1 of the cam 15*c* pressing the housing 13 rotates and moves around the rotation center 15*d*1 of the shaft 15*d*. Accordingly, the housing 13 is moved in a direction toward the shaft 15*d* while being pressed upstream in the rotational direction of the intermediate transfer belt 4 substantially in parallel to the tension surface 4*a*, which is a direction along a movement direction of the intermediate transfer belt 4 in FIG. 8, by the pressing force of the pressing member 14. Then, as illustrated in FIG. 9, the small diameter portion 15*c*2 of the cam 15*c* abuts against the housing 13. At this time, the secondary transfer inner roller 7 is located at the second position illustrated in FIG. 9.

In step S104, when it is determined that the sensor 22 is turned off, the secondary transfer inner roller 7 is located at the second position illustrated in FIG. 9. In this case, the process proceeds to step S108, and the CPU 16 determines whether or not the basis weight of the recording material 24 which the user has input in advance by operating the operation panel 17 indicates thin paper with reference to the information regarding the recording material 24 which is stored in the RAM 18.

In step S108, when it is determined that the basis weight of the recording material 24 passing through the secondary transfer nip portion N2 indicates thin paper, the process proceeds to step S109. In step S109, the CPU 16 causes the motor 15*a* of the roller displacement mechanism 15 to operate rotationally by certain pulses, so that the cam 15*c* is rotated 180 degrees from the state illustrated in FIG. 9 to the state illustrated in FIG. 8. At this time, the small diameter portion 15*c*2 of the cam 15*c* which has abutted against the housing 13 rotates and moves around the rotation center 15*d*1 of the shaft 15*d*. Then, the large diameter portion 15*c*1 of the cam 15*c* presses the housing 13 downstream in the rotational direction of the intermediate transfer belt 4 in parallel to the tension surface 4*a* of the intermediate transfer belt 4 in FIG. 8 against the pressing force of the pressing member 14. At this time, the secondary transfer inner roller 7 is located at the first position illustrated in FIG. 8.

In step S108, when it is determined that the basis weight of the recording material 24 passing through the secondary transfer nip portion N2 indicates thick paper, the process proceeds to step S110, and the CPU 16 maintains the state as it is without controlling the motor 15*a* of the roller displacement mechanism 15. At this time, the secondary transfer inner roller 7 is located at the second position illustrated in FIG. 9.

Following all of steps S106, S107, S109, and S110, the process proceeds to step S111. In step S111, the CPU 16 starts an imaging operation, and when the recording material 24 is thin paper, the recording material 24 passes through the secondary transfer nip portion N2 in a state where the secondary transfer inner roller 7 is located at the first position illustrated in FIG. 8. Meanwhile, when the recording material 24 is thick paper, the recording material 24 passes through the secondary transfer nip portion N2 in a state where the secondary transfer inner roller 7 is located at the second position illustrated in FIG. 9.

Thereafter, the process proceeds to step S112, and the CPU 16 determines whether or not the job is ended. In step S112, when it is determined that the job is ended, the process ends. In addition, in step S112, when it is determined that the job is continued, the process returns to step S103, and the same operation is performed.

<First Position and Second Position of Secondary Transfer Inner Roller>

Next, switching conditions for switching the secondary transfer inner roller 7 between the first position illustrated in FIG. 8 and the second position illustrated in FIG. 9 will be described with reference to FIGS. 7 to 9. FIG. 7 is a table describing switching conditions for switching the secondary transfer inner roller 7 between the first position illustrated in FIG. 8 and the second position illustrated in FIG. 9. FIG. 8 is a cross-sectional view illustrating the state of the secondary transfer inner roller 7 at the first position. FIG. 9 is a cross-sectional view illustrating the state of the secondary transfer inner roller 7 at the second position.

FIG. 7 shows the ON and OFF state of the sensor 22 according to the basis weight setting of the recording material 24, and whether a cam surface of the cam 15*c* which abuts against the housing 13 is the large diameter portion 15*c*1 illustrated in FIG. 8 or the small diameter portion 15*c*2 illustrated in FIG. 9. When the secondary transfer inner roller 7 is at the first position illustrated in FIGS. 7 and 8, the recording material 24 is thin paper having a basis weight of less than 52 gsm. Here, grams per square meter (gsm) used as the unit of the basis weight of the recording material 24 has the same meaning as "g/m$^2$", and is expressed by the numeral of grams per one square meter of the recording material 24.

The movement direction of the contact position of the secondary transfer inner roller 7 as a counter member, which is rotatably supported by the housing 13 as a bearing, with respect to the inner peripheral surface of the intermediate transfer belt 4 to the first position illustrated in FIG. 8 and the second position illustrated in FIG. 9 is taken into consideration. The movement direction at this time is the direction along the movement direction of the intermediate transfer belt 4 tensioned by the secondary transfer inner roller 7 and the idler roller 9, and is substantially parallel to the tension surface 4*a* of the intermediate transfer belt 4.

Further, the position of a rotation center 7*a*1 of the secondary transfer inner roller 7 when the secondary transfer inner roller 7 is located at the first position illustrated in FIG. 8 is taken into consideration. At this time, the position of the rotation center 7*a*1 is located downstream of a rotation center 10*a* of the secondary transfer outer roller 10 as a secondary transfer roller in the movement direction of the intermediate transfer belt 4 tensioned by the secondary transfer inner roller 7 and the idler roller 9.

The position of the rotation center 7*a*1 of the secondary transfer inner roller 7 when the secondary transfer inner roller 7 is located at the second position illustrated in FIG. 9 is taken into consideration. At this time, the position of the rotation center 7*a*1 is located at a position coincident with the rotation center 10*a* of the secondary transfer outer roller 10 in the movement direction of the intermediate transfer belt 4 tensioned by the secondary transfer inner roller 7 and the idler roller 9. Alternatively, the position of the rotation center 7*a*1 is located upstream of the rotation center 10*a* of the secondary transfer outer roller 10. Incidentally, when the rotation center 7*a*1 of the secondary transfer inner roller 7 is located upstream or downstream of the rotation center 10*a* of the secondary transfer outer roller 10, the secondary transfer inner roller 7 and the secondary transfer outer roller 10 are located in a range in which the secondary transfer inner roller 7 and the secondary transfer outer roller 10 can form a nip portion with the intermediate transfer belt 4 interposed therebetween.

Reference sign 7*a*1 illustrated in FIGS. 8 and 9 denotes the rotation center of the rotational shaft 7*a* of the secondary transfer inner roller 7 as a counter member. In addition, reference sign 10*a* denotes the rotation center of the secondary transfer outer roller 10 as a secondary transfer roller. In addition, a virtual line a illustrated in FIG. 8 is a line of extension of the tension surface 4*a* of the intermediate transfer belt 4 tensioned by the secondary transfer inner roller 7 and the idler roller 9, and is along the conveyance direction of the recording material 24 that has passed through the secondary transfer nip portion N2. A virtual line b illustrated in FIG. 9 is a line of extension of the tension surface 4*a* of the intermediate transfer belt 4 tensioned by the secondary transfer inner roller 7 and the idler roller 9. A virtual line d illustrated in FIG. 9 is along the conveyance direction of the recording material 24 that has passed through the secondary transfer nip portion N2.

<First Position of Secondary Transfer Inner Roller>

The first position of the secondary transfer inner roller 7 illustrated in FIGS. 7 and 8 is a configuration of the secondary transfer portion 21 when the recording material 24 is thin paper having a basis weight of less than 52 gsm. Specifically, the CPU 16 causes the motor 15*a* to stop at a position at which the sensor 22 illustrated in FIG. 5 detects the flag 15*e* configured to receive the driving force of the motor 15*a* of the roller displacement mechanism 15 to rotate around the shaft 15*d* as a center. At this time, the cam 15*c* rotating coaxially with the shaft 15*d* and integrally with the shaft 15*d* operates rotationally. Accordingly, the cam 15*c* presses the housing 13 downstream in the conveyance direction of the recording material 24 against the pressing force of the pressing member 14 and in parallel to the tension surface 4*a* of the intermediate transfer belt 4 tensioned by the secondary transfer inner roller 7 and the idler roller 9.

Accordingly, regarding the positional relationship between the secondary transfer inner roller 7 and the secondary transfer outer roller 10, as illustrated in FIG. 8, the secondary transfer inner roller 7 is located downstream of the secondary transfer outer roller 10 in the conveyance direction of the recording material 24. Specifically, the secondary transfer inner roller 7 is offset downstream of the secondary transfer outer roller 10 in the conveyance direction of the recording material 24 by the movement amount D of 2.5 mm and in parallel to the tension surface 4*a* of the intermediate transfer belt 4 tensioned by the secondary transfer inner roller 7 and the idler roller 9. Here, the movement amount D of 2.5 mm is a difference between the diameter D1 of the large diameter portion 15*cl* and the diameter D2 of the small diameter portion 15*c*2 which have the rotation center 15*d*1 of the shaft 15*d* of the cam 15*c* as a center.

With the above configuration, an angle P1 increases which is formed between a conveyance direction a of the recording material 24 immediately after the recording material 24 has passed through the secondary transfer nip portion N2 and the intermediate transfer belt 4 immediately after the intermediate transfer belt 4 has passed through the secondary transfer nip portion N2, and which is formed downstream of the secondary transfer nip portion N2 in the conveyance direction of the recording material 24. Accordingly, when the secondary transfer inner roller 7 is at the first position illustrated in FIG. 8, in a case where thin paper is used as the recording material 24, the separability of the recording material 24 immediately after the recording material 24 has passed through the secondary transfer nip portion N2 can be secured.

<Second Position of Secondary Transfer Inner Roller>

The second position of the secondary transfer inner roller 7 illustrated in FIGS. 7 and 9 is a configuration of the secondary transfer portion 21 when the recording material 24 is thick paper having a basis weight of 52 gsm or more. Specifically, the CPU 16 causes the motor 15*a* to rotate by certain pulses after the sensor 22 illustrated in FIG. 5 has detected the flag 15*e*, which receives the driving force of the motor 15*a* of the roller displacement mechanism 15 to rotate around the shaft 15*d* as a center, and to stop. At this time, the cam 15*c* rotating coaxially with the shaft 15*d* and integrally with the shaft 15*d* operates rotationally, so that the cam 15*c* rotates 180 degrees with respect to the first position illustrated in FIG. 8 and stops at the second position illustrated in FIG. 9.

At this time, the pressing member 14 presses the housing 13 upstream in the conveyance direction of the recording material 24 and in parallel to the tension surface 4*a* of the intermediate transfer belt 4 tensioned by the secondary transfer inner roller 7 and the idler roller 9. At this time, the movement amount D of the secondary transfer inner roller 7 that is rotatably supported by the housing 13 is a movement from the first position illustrated in FIG. 8 by 2.5 mm that is a difference between the diameter D1 of the large diameter portion 15*c*1 and the diameter D2 of the small diameter portion 15*c*2 which have the rotation center 15*d*1 of the shaft 15*d* of the cam 15*c* as a center.

Accordingly, the positional relationship between the secondary transfer inner roller 7 and the secondary transfer outer roller 10 changes from the first position illustrated in FIG. 8 to the second position illustrated in FIG. 9. Specifically, the secondary transfer inner roller 7 and the secondary transfer outer roller 10 are parallel to the tension surface 4*a* of the intermediate transfer belt 4 tensioned by the secondary transfer inner roller 7 and the idler roller 9, and are not offset from each other.

An angle P2 is taken into consideration which is formed between a conveyance direction d of the recording material 24 immediately after the recording material 24 has passed through the secondary transfer nip portion N2 and the intermediate transfer belt 4 immediately after the intermediate transfer belt 4 has passed through the secondary transfer nip portion N2, and which is formed downstream of the secondary transfer nip portion N2 in the conveyance direction of the recording material 24. The angle P2 is smaller than the angle P1 when the secondary transfer inner roller 7 is located at the first position illustrated in FIG. 8.

For this reason, a conveyance path of the recording material 24 is suppressed from being bent and causing an increase in conveyance resistance of the recording material 24. In addition, a velocity difference between the conveyance velocity of a middle portion of the recording material 24 being conveyed by the registration roller 11 and the conveyance velocity of a rear end portion of the recording material 24 after the recording material 24 has been extracted from the registration roller 11 is unlikely to occur. Accordingly, it is possible to suppress the generation of horizontal stripes caused by transfer shift, or transfer defects caused by the jumping up of the rear end portion of the recording material 24 after the recording material 24 has been extracted from the registration roller 11.

In addition, the secondary transfer inner roller 7 is displaced parallel to the tension surface 4*a* of the intermediate transfer belt 4 tensioned by the secondary transfer inner roller 7 and the idler roller 9. Accordingly, the tension posture of the intermediate transfer belt 4 in the vicinity of the secondary transfer inner roller 7 does not change. Accordingly, tip scraping does not occur which scrapes the toner images on the outer peripheral surface of the intermediate transfer belt 4 before a tip portion of the recording material 24 conveyed from the registration roller 11 enters the secondary transfer nip portion N2.

In addition, it is also possible to suppress an image trouble such as a horizontal stripe image caused by the occurrence of a fluctuation in velocity of the intermediate transfer belt 4 when the tip portion of the recording material 24 conveyed from the registration roller 11 rushes to the intermediate transfer belt 4. In addition, since only the secondary transfer inner roller 7 is displaced, the conveyance path of the recording material 24 is not changed, so that a jam of the recording material 24 can be suppressed which is caused by a change in gap between guides which occurs when the secondary transfer outer roller 10 is displaced.

Second Embodiment

1. Entire Configuration and Operation of Image Forming Apparatus

Figure 10:
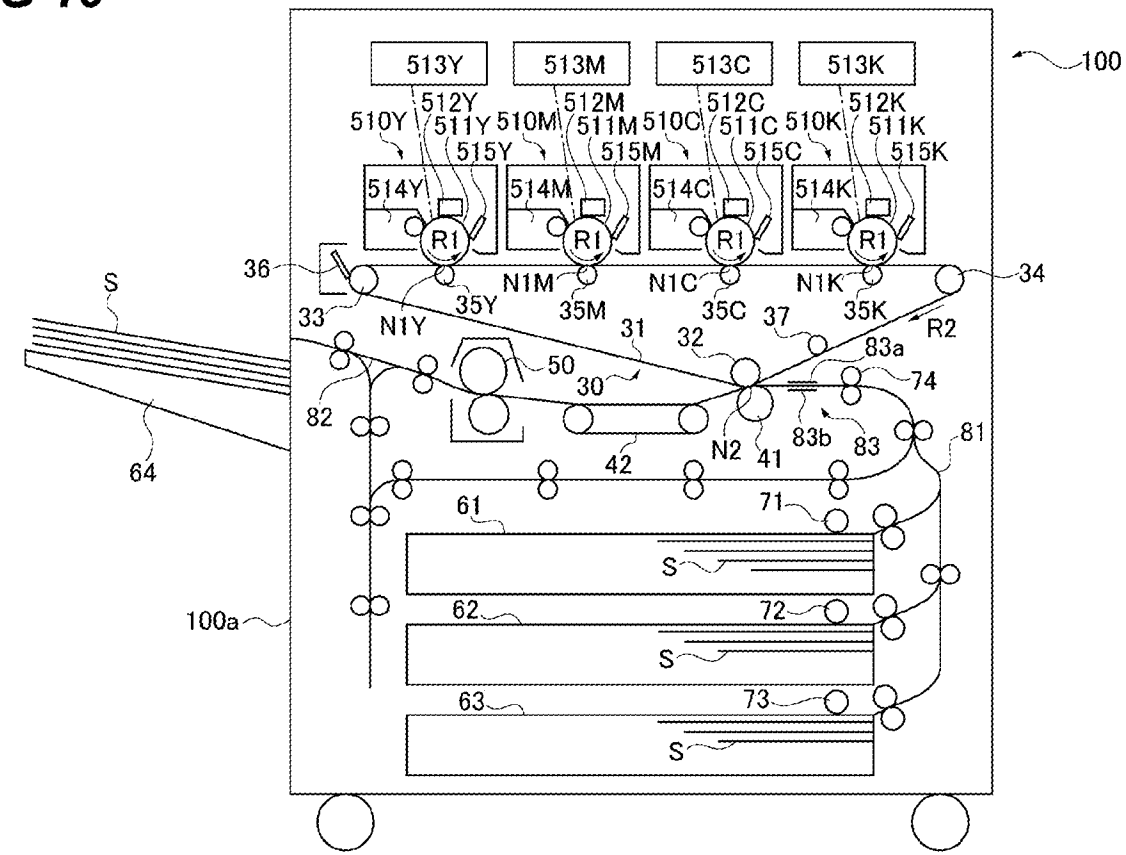
FIG. 10 is a schematic cross-sectional view of the image forming apparatus.

FIG. 10 is a schematic cross-sectional view of an image forming apparatus 100 of the present embodiment. The image forming apparatus 100 of the present embodiment is a tandem type multi-functional machine (having the functions of a copying machine, a printer, and a facsimile apparatus) adopting an intermediate transfer system. The image forming apparatus 100 is capable of forming a full color image on a recording material (transfer material or sheet material) S having a sheet shape such as paper by using an electrophotographic system, for example, according to an image signal transmitted from an external apparatus.

The image forming apparatus 100 includes four image forming portions 510Y, 510M, 510C, and 510K as a plurality of image forming portions which form yellow (Y), magenta (M), cyan (C), black (K) images, respectively. The image forming portions 510Y, 510M, 510C, and 510K are disposed in series along a movement direction of an image transfer surface of an intermediate transfer belt 31 to be described later, the image transfer surface being disposed substantially horizontally. Regarding components having the same or corresponding functions or configurations in the image forming portions 510Y, 510M, 510C, and 510K, Y, M, C, and K at the ends of reference signs denoting components for each color may be omitted and the components may be collectively described. In the present embodiment, an image forming portion 510 includes a photosensitive drum 511 (511Y, 511M, 511C, and 511K); a charging device 512 (512Y, 512M, 512C, and 512K); an exposure apparatus 513 (513Y, 513M, 513C, and 513K); a development device 514 (514Y, 514M, 514C, and 514K); a primary transfer roller 35 (35Y, 35M, 35C, and 35K); a cleaning apparatus 515 (515Y, 515M, 515C, and 515K); and the like.

The photosensitive drum 511 that is a rotatable drum-shaped (cylindrical) photosensitive member (electrophotographic photosensitive member) as a first image bearing member configured to bear a toner image is rotationally driven in an arrow R1 direction (counterclockwise) in the drawing. A surface of the rotating photosensitive drum 511 is uniformly charged to a predetermined potential of a predetermined polarity (negative polarity in the present embodiment) by the charging device 512 as a charging portion. The charged surface of the photosensitive drum 511 is scanned and exposed according to an image signal by the exposure apparatus 513 as an exposure portion (electrostatic image forming portion), so that an electrostatic image (electrostatic latent image) is formed on the photosensitive drum 511. In the present embodiment, the exposure apparatus 513 is formed of a laser scanner apparatus configured to irradiate the photosensitive drum 511 with laser light modulated according to the image signal. The development device 514 as a development portion supplies a toner as a developer to the electrostatic image formed on the photosensitive drum 511 to develop (visualize) the electrostatic image, so that a toner image (developer image) is formed on the photosensitive drum 511. In the present embodiment, the toner charged to the same polarity (negative polarity in the present embodiment) as the charging polarity of the photosensitive drum 511 which has been lowered in absolute potential value by being uniformly charged and then exposed adheres to an exposed portion (image portion) on the photosensitive drum 511 (inversion development).

The intermediate transfer belt 31, which is a rotatable intermediate transfer member formed of an endless belt as a second image bearing member configured to bear the toner image, is disposed to face four photosensitive drums 511Y, 511M, 511C, and 511K. The intermediate transfer belt 31 is suspended around a driving roller 33, a tension roller 34, a secondary pre-transfer roller 37, and an inner roller (secondary transfer counter roller or inner member) 32 as a plurality of tension rollers (support rollers), and is tensioned at a predetermined tension. The driving roller 33 transmits a driving force to the intermediate transfer belt 31. The tension roller 34 applies to a predetermined tension to the intermediate transfer belt 31. The secondary pre-transfer roller 37 forms a surface of the intermediate transfer belt 31 in the upstream vicinity of a secondary transfer nip N2 (to be described later) with respect to a rotational direction (traveling direction) of the intermediate transfer belt 31. The inner roller 32 functions as a counter member (counter electrode) of an outer roller 41 (to be described later). The driving roller 33 is rotationally driven, so that the intermediate transfer belt 31 rotates (moves in an orbiting manner) in an arrow R2 direction (clockwise) in the drawing. In the present embodiment, the intermediate transfer belt 31 is rotationally driven such that, as one example, the circumferential velocity is 400 mm/sec. The support rollers other than the driving roller 33 among the plurality of support rollers are driven to rotate as the intermediate transfer belt 31 rotates. The primary transfer rollers 35Y, 35M, 35C, and 35K that are roller-shaped primary transfer members as primary transfer portions are disposed on an inner peripheral surface side of the intermediate transfer belt 31 to correspond to the photosensitive drums 511Y, 511M, 511C, and 511K, respectively. The primary transfer roller 35 presses the intermediate transfer belt 31 toward the photosensitive drum 511 to form a primary transfer nip N1 as a primary transfer portion that is a contact portion between the photosensitive drum 511 and the intermediate transfer belt 31. The toner image formed on the photosensitive drum 511 as described above is primarily transferred on to the rotating intermediate transfer belt 31 in the primary transfer nip N1 by the action of the primary transfer roller 35. During primary transfer, a primary transfer voltage that is a DC voltage of an opposite-polarity from the normal charging polarity of the toner (charging polarity of the toner during development) is applied to the primary transfer roller 35 by a primary transfer power supply (not illustrated). For example, when a full color image is formed, toner images of yellow, magenta, cyan, and black colors which are formed on the respective photosensitive drums 511 are primarily transferred in sequence so as to be superimposed on top of each other in the same image forming region on the intermediate transfer belt 31. In the present embodiment, the primary transfer nip N1 is an image forming position at which the toner image is to be formed on the intermediate transfer belt 31. Then, the intermediate transfer belt 31 is one example of a rotatable endless belt configured to convey the toner image that is borne at the image forming position.

The outer roller (secondary transfer roller or outer member) 41 that is a roller-shaped secondary transfer member as a secondary transfer portion is disposed on an outer peripheral surface side of the intermediate transfer belt 31 at a position at which the outer roller 41 faces the inner roller 32. The outer roller 41 is pressed toward the inner roller 32 via the intermediate transfer belt 31 to form the secondary transfer nip N2 as a secondary transfer portion that is a contact portion between the intermediate transfer belt 31 and the outer roller 41. The toner image formed on the intermediate transfer belt 31 as described above is secondarily transferred on to the recording material S, which is nipped between the intermediate transfer belt 31 and the outer roller 41 and is conveyed, in the secondary transfer nip N2 by the action of the outer roller 41. In the present embodiment, during secondary transfer, a secondary transfer voltage that is a DC voltage of an opposite-polarity from the normal charging polarity of the toner is applied to the outer roller 41 by a secondary transfer power supply (not illustrated). In the present embodiment, the inner roller 32 is electrically grounded (grounded to the ground). Incidentally, the inner roller 32 may be used as a secondary transfer member, so that a secondary transfer voltage of the same polarity as the normal charging polarity of the toner is applied to the inner roller 32, and the outer roller 41 may be used as a counter electrode, so that the outer roller 41 is electrically grounded.

The recording material S is conveyed to the secondary transfer nip N2 at the timing when the toner image on the intermediate transfer belt 31 reaches the secondary transfer nip N2. Namely, the recording materials S stored in recording material cassettes 61, 62, and 63 are sent out when any of feeding rollers 71, 72, and 73 rotates. The recording material S is conveyed to registration rollers (a pair of registration rollers) 74, which are conveying members as conveying portions, through a feeding conveyance path 81, and is stopped for the moment. Then, the registration rollers 74 are rotationally driven such that the toner image on the intermediate transfer belt 31 and a desired image forming region on the recording material S coincide with each other in the secondary transfer nip N2, so that the recording material S is sent into the secondary transfer nip N2. A conveying guide 83 configured to guide the recording material S to the secondary transfer nip N2 is provided downstream of the registration rollers 74 and upstream of the secondary transfer nip N2 with respect to a conveyance direction of the recording material S. The conveying guide 83 includes a first guide member 83*a* capable of coming into contact with a front surface of the recording material S (surface on to which the toner image is to be transferred immediately after the recording material S has passed through the conveying guide 83), and a second guide member 83*b* capable of coming into contact with a back surface (surface opposite the front surface) of the recording material S. The first guide member 83*a* and the second guide member 83*b* are disposed to face each other, and the recording material S passes between both members. The first guide member 83*a* restricts movement of the recording material S in a direction toward the intermediate transfer belt 31. The second guide member 83*b* restricts movement of the recording material S in a direction away from the intermediate transfer belt 31.

The recording material S on to which the toner image has been transferred is conveyed to a fixing apparatus 50 as a fixing portion by a conveying belt 42. The fixing apparatus 50 heats and pressurizes the recording material S, which has borne an unfixed toner image, to fix (melt and fix) the toner image to a surface of the recording material S. Thereafter, the recording material S to which the toner image has fixed is discharged (output) to a discharge tray 64, which is provided outside an apparatus main body 100*a* of the image forming apparatus 100, through a discharge conveyance path 82.

Meanwhile, the toner that has remained on the photosensitive drum 511 after primary transfer (primary transfer residual toner) is removed and recovered from the photosensitive drum 511 by the cleaning apparatus 515 as a cleaning portion. In addition, the toner that has remained on the intermediate transfer belt 31 after secondary transfer (secondary transfer residual toner) or adhering matter such as paper dust that has adhered to the intermediate transfer belt 31 from the recording material S is removed and recovered from the intermediate transfer belt 31 by a belt cleaning apparatus 36 as an intermediate transfer member cleaning portion.

Incidentally, in the present embodiment, an intermediate transfer belt unit 30 as a belt conveying apparatus includes the intermediate transfer belt 31 tensioned by the plurality of tension rollers; each of the primary transfer rollers 35; the belt cleaning apparatus 36; a frame configured to support these components; and the like. The intermediate transfer belt unit 30 is detachably attachable to the apparatus main body 100*a* for maintenance or replacement.

Here, a belt made of a resin material having a single-layer or multi-layer structure can be used as the intermediate transfer belt 31. In addition, a belt having a thickness of 40 μm or more, a Young's modulus of 1.0 GPa or more, and a surface resistivity of $1.0\times10^{9}$ to $5.0\times10^{13}\Omega/\square$ can be preferably used as the intermediate transfer belt 31.

In addition, in the present embodiment, the inner roller 32 is formed by providing an elastic layer (rubber layer) made of a rubber material as an elastic material on an outer periphery of a core bar (base member) made of metal. The elastic layer can be made of, for example, EPDM rubber (may contain a conductive agent) or the like. In the present embodiment, the inner roller 32 is formed such that the outer diameter of the inner roller 32 is 20 mm and the thickness of the elastic layer is 0.5 mm. In addition, in the present embodiment, the hardness of the elastic layer of the inner roller 32 is set to, for example, 70° (JIS-A). Incidentally, the inner roller 32 may be formed of a metallic roller made of a metallic material such as SUM or SUS. Incidentally, the secondary pre-transfer roller 37 can have the same configuration as that of the inner roller 32.

In addition, in the present embodiment, the outer roller 41 is formed by providing a conductive elastic layer (may be a solid rubber layer or a sponge layer (foam elastic layer)) made of a conductive rubber material as a conductive elastic material on an outer periphery of a core bar (base member) made of metal. The elastic layer can be made of, for example, NBR rubber, EPDM rubber, or the like containing a conductive agent such as a metallic complex or carbon. In the present embodiment, the outer roller 41 is formed such that the outer diameter of the core bar is 12 mm, the thickness of the elastic layer is 6 mm, and the outer diameter of the outer roller 41 is 24 mm. In addition, in the present embodiment, the hardness of the elastic layer of the outer roller 41 is set to, for example, 28° (Asker-C). In addition, in the present embodiment, the outer roller 41 is biased to abut against the inner roller 32 at a predetermined pressure with the intermediate transfer belt 31 interposed therebetween by a pressing spring 44 (FIGS. 11A and 11B) that is a biasing member (elastic member) as a biasing portion.

Incidentally, in the present embodiment, respective rotational axis directions of the tension rollers of the intermediate transfer belt 31 which includes the inner roller 32, and the outer roller 41 are substantially parallel to each other. A support configuration of the inner roller 32 and the outer roller 41 will be further described later.

2. Offset

Figure 18A:
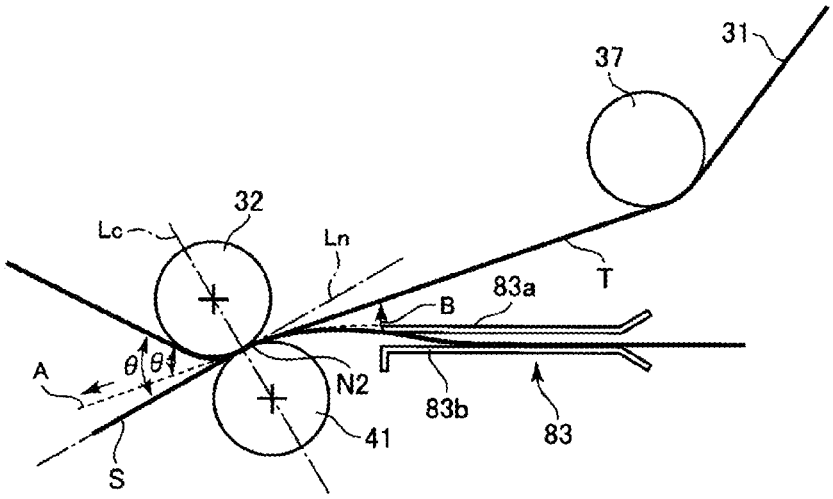
FIGS. 18A and 18B are schematic views for describing a behavior of a recording material in the vicinity of a secondary transfer nip.

FIG. 18A is a schematic cross-sectional view (cross section substantially orthogonal to the rotational axis direction of the inner roller 32) for describing a behavior of the recording material S in the vicinity of the secondary transfer nip N2. Incidentally, in FIG. 18A, components having the same or corresponding functions or configurations as those of the image forming apparatus 100 of the present embodiment are denoted by the same reference signs.

As described above, a behavior of the recording material S in the upstream vicinity or in the downstream vicinity of the secondary transfer nip N2 with respect to the conveyance direction of the recording material S is changed depending on the shape of the secondary transfer nip N2 (position of the secondary transfer nip N2) or the stiffness of the recording material S. Then, for example, when the recording material S is "thin paper" that is one example of the recording material S having a small stiffness, a jam (paper jam) may occur due to poor separation of the recording material S from the intermediate transfer belt 31. Since the recording material S easily sticks to the intermediate transfer belt 31 due to weak stiffness of the recording material S, this phenomenon is remarkable when the stiffness of the recording material S is small.

Namely, in the cross section illustrated in FIG. 18A, a line indicating a tension surface of the intermediate transfer belt 31 formed in a tensioned state by the inner roller 32 and the secondary pre-transfer roller 37 is defined as a tension line T. Incidentally, the secondary pre-transfer roller 37 is one example of an upstream roller that is disposed upstream of the inner roller 32 with respect to the rotational direction of the intermediate transfer belt 31 to be adjacent to the inner roller 32 among the plurality of tension rollers. In addition, in the same cross section, a straight line passing through a rotation center of the inner roller 32 and a rotation center of the outer roller 41 is defined as a nip center line Lc. In addition, in the same cross section, a line substantially orthogonal to the nip center line Lc is defined as a nip line Ln. Incidentally, FIG. 18A illustrates a state where the rotation center of the outer roller 41 is offset further upstream in the rotational direction of the intermediate transfer belt 31 from the rotation center of the inner roller 32 with respect to a direction along the tension line T.

At this time, the recording material S tends to maintain a posture substantially along the nip line Ln in a state where the recording material S is nipped between the inner roller 32 and the outer roller 41 in the secondary transfer nip N2. For this reason, generally, when the rotation center of the inner roller 32 and the rotation center of the outer roller 41 are close to each other with respect to the direction along the tension line T, as illustrated by a dotted line A in FIG. 18A, a discharge angle θ of the recording material S is reduced. Namely, a tip in the conveyance direction of the recording material S is postured to be discharged close to the intermediate transfer belt 31 when being discharged from the secondary transfer nip N2. Accordingly, the recording material S easily sticks to the intermediate transfer belt 31. Meanwhile, generally, the further upstream the rotation center of the outer roller 41 is disposed in the rotational direction of the intermediate transfer belt 31 from the rotation center of the inner roller 32 with respect to the direction along the tension line T, the more the discharge angle θ of the recording material S increases as illustrated by a solid line in FIG. 18A. Namely, the tip in the conveyance direction of the recording material S is postured to be discharged in a direction away from the intermediate transfer belt 31 when being discharged from the secondary transfer nip N2. Accordingly, the recording material S is unlikely to stick to the intermediate transfer belt 31.

Meanwhile, as described above, for example, in a case where the recording material S is "thick paper" that is one example of the recording material S having a large stiffness, when a rear end in the conveyance direction of the recording material S is extracted from the conveying guide 83, a rear end portion in the conveyance direction of the recording material S may collide with the intermediate transfer belt. Accordingly, an image defect may occur in the rear end portion in the conveyance direction of the recording material S. Since the rear end portion in the conveyance direction of the recording material S is likely to collide with the intermediate transfer belt 31 with strong force due to strong stiffness of the recording material S, this phenomenon is remarkable when the stiffness of the recording material S is large.

Namely, as described above, in the cross section illustrated in FIG. 18A, the recording material S tends to maintain a posture substantially along the nip line Ln in a state where the recording material S is nipped between the inner roller 32 and the outer roller 41 in the secondary transfer nip N2. For this reason, generally, the further upstream the rotation center of the outer roller 41 is disposed in the rotational direction of the intermediate transfer belt 31 from the rotation center of the inner roller 32 with respect to the direction along the tension line T, the more the nip line Ln bites into the tension line T. As a result, when the rear end in the conveyance direction of the recording material S is extracted from the conveying guide 83, as illustrated by a dotted line B in FIG. 18A, the rear end portion in the conveyance direction of the recording material S collides with the intermediate transfer belt 31, so that an image defect is likely to occur in the rear end portion in the conveyance direction of the recording material S. Meanwhile, generally, when the rotation center of the inner roller 32 and the rotation center of the outer roller 41 are close to each other with respect to the direction along the tension line T, the rear end in the conveyance direction of the recording material S is suppressed from colliding with the intermediate transfer belt 31 when being extracted from the conveying guide 83. Accordingly, an image defect is unlikely to occur in the rear end portion in the conveyance direction of the recording material S.

Figure 19:
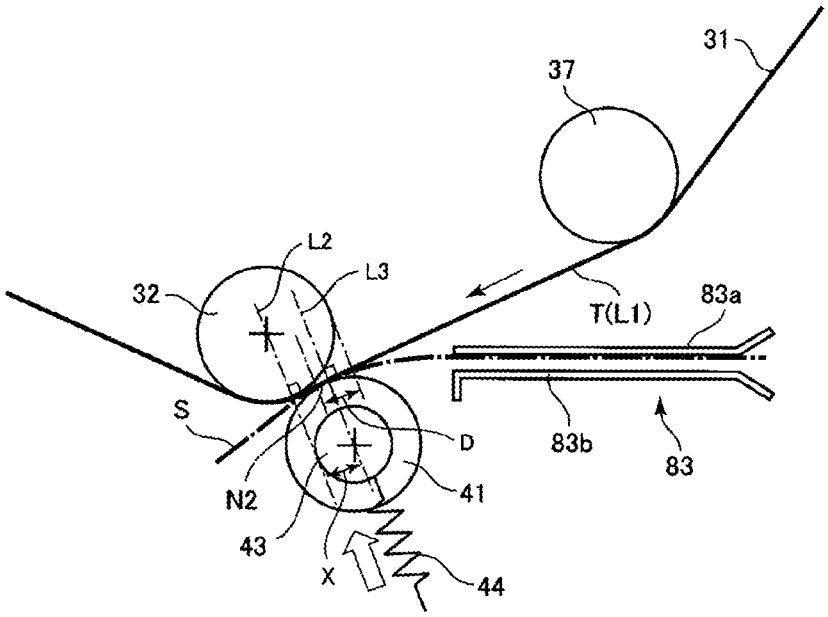
FIG. 19 is a schematic cross-sectional view for describing an offset amount.

As countermeasures against such problems, it is effective to change the relative position between the inner roller 32 and the outer roller 41 with respect to a circumferential direction of the inner roller 32 (rotational direction of the intermediate transfer belt 31) according to the type of the recording material S. FIG. 19 is a schematic cross-sectional view (cross section substantially orthogonal to the rotational axis direction of the inner roller 32) of the vicinity of the secondary transfer nip N2 for describing the definition of the relative position between the inner roller 32 and the outer roller 41. Incidentally, in FIG. 19, components having the same or corresponding functions or configurations as those of the image forming apparatus 100 of the present embodiment are denoted by the same reference signs.

In the cross section illustrated in FIG. 19, a common tangent line of the inner roller 32 and the secondary pre-transfer roller 37 on a side on which the intermediate transfer belt 31 is suspended is defined as a reference line L1. The reference line L1 corresponds to the tension line T when the intermediate transfer belt 31 is not projected to the outer peripheral surface side by a pressing member 39 to be described later. In addition, in the same cross section, a straight line that passes through the rotation center of the inner roller 32 and is substantially orthogonal to the reference line L1 is defined as an inner roller center line L2. In addition, in the same cross section, a straight line that passes through the rotation center of the outer roller 41 and is substantially orthogonal to the reference line L1 is defined as an outer roller center line L3. At this time, the distance (vertical distance) between the inner roller center line L2 and the outer roller center line L3 is defined as an offset amount X (here, a positive value when the outer roller center line L3 is located upstream of the inner roller center line L2 in the rotational direction of the intermediate transfer belt 31). The offset amount X can have a negative value, 0, and a positive value. When the offset amount X is increased, the width of the secondary transfer nip N2 with respect to the rotational direction of the intermediate transfer belt 31 is widened upstream in the rotational direction of the intermediate transfer belt 31. Namely, an upstream end portion of a contact region between the outer roller 41 and the intermediate transfer belt 31 in the rotational direction of the intermediate transfer belt 31 is located upstream of an upstream end portion of a contact region between the inner roller 32 and the intermediate transfer belt 31 in the rotational direction of the intermediate transfer belt 31. In such a manner, the relative position between the inner roller 32 and the outer roller 41 with respect to the circumferential direction of the inner roller 32 is changed by changing the position of at least one of the inner roller 32 and the outer roller 41, so that the position of the secondary transfer nip (transfer portion) N2 can be changed.

In FIG. 19, the outer roller 41 is illustrated as virtually being in contact with the reference line L1 (tension line T) without being deformed. However, as described above, the material of the outermost layer of the outer roller 41 is an elastic member such as rubber or sponge, and actually, the outer roller 41 is pressed and deformed in a direction toward the inner roller 32 (white arrow direction in the drawing) by the pressing spring 44. When the outer roller 41 is offset and disposed upstream in the rotational direction of the intermediate transfer belt 31 with respect to the inner roller 32, and is pressed by the pressing spring 44 such that the intermediate transfer belt 31 is nipped between the inner roller 32 and the outer roller 41, the secondary transfer nip N2 having a substantially S shape is formed. Then, the posture of the recording material S that is guided and sent by the conveying guide 83 is also determined according to the shape of the secondary transfer nip N2. The more the offset amount X is increased, the more the recording material S is bent. For this reason, as described above, for example, when the recording material S is "thin paper", the separability of the recording material S from the intermediate transfer belt 31 after the recording material S has passed through the secondary transfer nip N2 can be improved by increasing the offset amount X. However, if the offset amount X is large, as described above, for example, in a case where the recording material S is "thick paper", when the rear end in the conveyance direction of the recording material S is extracted from the conveying guide 83, the rear end portion in the conveyance direction of the recording material S collides with the intermediate transfer belt 31. Accordingly, this is a factor to decrease the image quality of the rear end portion in the conveyance direction of the recording material S. For this reason, in this case, the offset amount X may be reduced.

3. Pressing Member

Figure 18B:
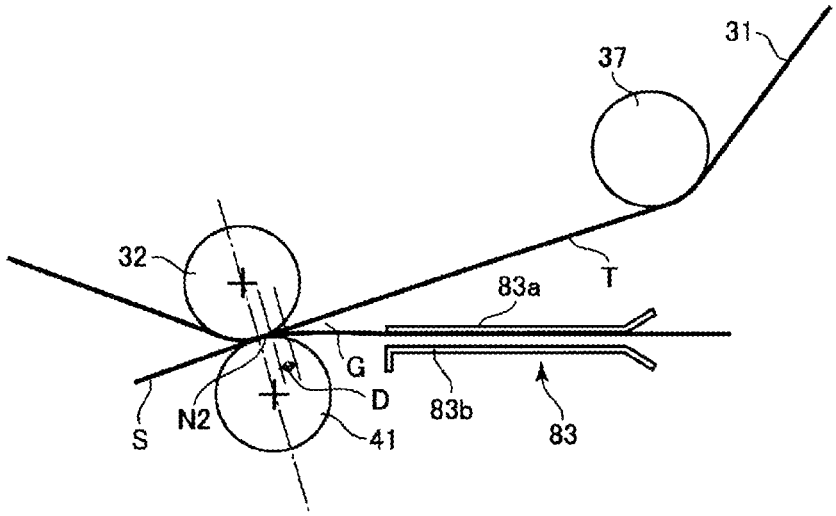

FIG. 18B is a schematic cross-sectional view (cross section substantially orthogonal to the rotational axis direction of the inner roller 32) for describing the conveyance posture of the recording material S in the vicinity of the secondary transfer nip N2. Incidentally, in FIG. 18B, components having the same or corresponding functions or configurations as those of the image forming apparatus 100 of the present embodiment are denoted by the same reference signs. Incidentally, FIG. 18B illustrates a state where the rotation center of the inner roller 32 and the rotation center of the outer roller 41 are disposed at substantially the same position with respect to the direction along the tension line T.

As described above, the posture of the recording material S that is conveyed from the conveying guide 83 to the secondary transfer nip N2 changes depending on the stiffness of the recording material S. Then, for example, when the recording material S is "thick paper", a gap G is likely to be generated between the intermediate transfer belt 31 and the recording material S in the vicinity of an inlet of the secondary transfer nip N2, so that "scattering" is likely to occur.

Namely, in FIG. 18B, the distance by which the intermediate transfer belt 31 and the recording material S are in contact with each other along a movement direction of the intermediate transfer belt 31 in the vicinity of the inlet of the secondary transfer nip N2 (in the upstream vicinity of the inner roller 32 with respect to the rotational direction of the intermediate transfer belt 31) is defined as a contact distance D. In more detail, the contact distance D is the distance between the start position of contact between the inner roller 32 and the intermediate transfer belt 31 and the start position of contact between the recording material S and the intermediate transfer belt 31 with respect to the movement direction of the intermediate transfer belt 31. For example, when the recording material S is "thick paper", the stiffness of the recording material S is large, so that the recording material S is unlikely to be bent in the vicinity of the inlet of the secondary transfer nip N2, and thus the contact distance D is reduced. For this reason, the gap G is generated between the intermediate transfer belt 31 and the recording material S, electric discharge occurs in the gap G due to the influence of a transfer electric field, and the toner image scatters, so that an image defect ("scattering") may occur.

As countermeasures against such a problem, providing a pressing member configured to come into contact with an inner peripheral surface of the intermediate transfer belt 31 in the vicinity of the inlet of the secondary transfer nip N2 is effective in reducing the gap G in the vicinity of the inlet of the secondary transfer nip N2.

Figure 20A:
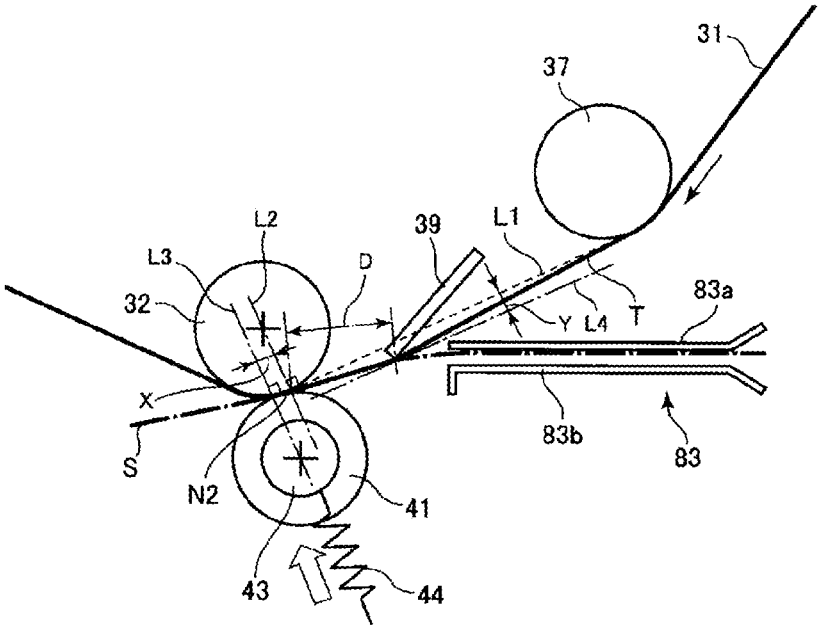
FIGS. 20A and 20B are schematic cross-sectional views for describing an intrusion amount.
Figure 20B:
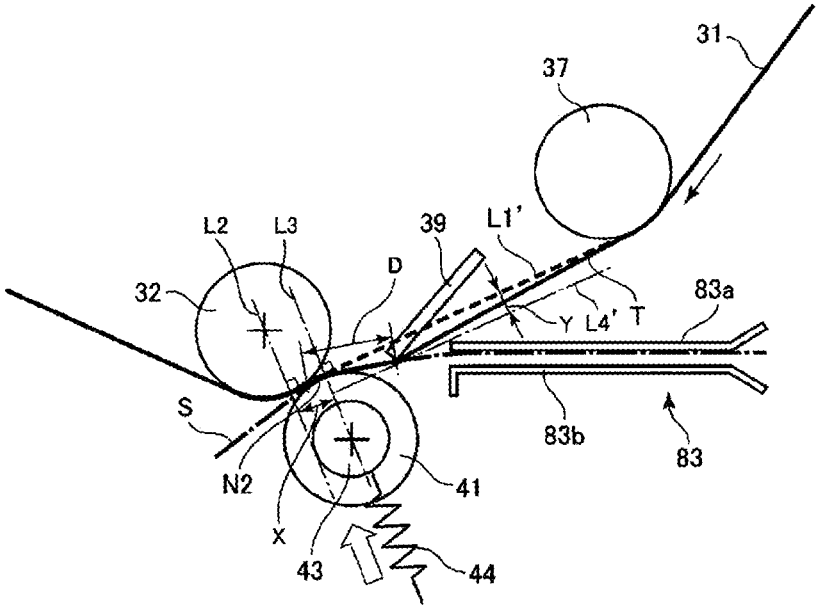

FIGS. 20A and 20B are schematic cross-sectional views (cross sections substantially orthogonal to the rotational axis direction of the inner roller 32) for describing the definition of the intrusion amount of the pressing member with respect to the intermediate transfer belt 31. Incidentally, in FIGS. 20A and 20B, components having the same or corresponding functions or configurations as those of the image forming apparatus 100 of the present embodiment are denoted by the same reference signs.

In the examples illustrated in FIGS. 20A and 20B, in the image forming apparatus 100, the pressing member (backup sheet) 39 having a sheet shape and being configured to press the inner peripheral surface of the intermediate transfer belt 31 to cause the intermediate transfer belt 31 to project to the outer peripheral surface side is provided in the vicinity of the inlet of the secondary transfer nip N2. The pressing member 39 is disposed to come into contact with the inner peripheral surface of the intermediate transfer belt 31 on an upstream side of the inner roller 32 and on a downstream side of the secondary pre-transfer roller 37 with respect to the rotational direction of the intermediate transfer belt 31. The pressing member 39 presses the intermediate transfer belt 31 from the inner peripheral surface side toward the outer peripheral surface side to cause the intermediate transfer belt 31 to project to the outer peripheral surface side. Namely, the pressing member 39 abuts against the intermediate transfer belt 31 with a predetermined intrusion amount with respect to the intermediate transfer belt 31. The intrusion amount is a substantially amount by which the pressing member 39 causes the intermediate transfer belt 31 to project outward with respect to the tension line T indicating the tension surface of the intermediate transfer belt 31 formed in a tensioned state by the inner roller 32 or the outer roller 41 and the secondary pre-transfer roller 37. Incidentally, the definition of the intrusion amount (the intrusion amount of the pressing member 39 with respect to the intermediate transfer belt 31) Y differs between when the offset amount X is positive and when the offset amount X is 0 or negative. FIG. 20A illustrates a case where the offset amount X is 0 or a negative value (particularly, negative value), and FIG. 20B illustrates a case where the offset amount X is a positive value.

First, a case where the offset amount X is 0 or a negative value will be described. As illustrated in FIG. 20A, in the cross section substantially orthogonal to the rotational axis direction of the inner roller 32, the common tangent line of the inner roller 32 and the secondary pre-transfer roller 37 on the side on which the intermediate transfer belt 31 is suspended is defined as the reference line L1. In addition, in the same cross section, a tangent line of the intermediate transfer belt 31 is defined as a pressing portion tangent line L4, the tangent line being substantially parallel to the reference line L1 and being in contact with an outer peripheral surface of the intermediate transfer belt 31 in a region in which the pressing member 39 is in contact with the intermediate transfer belt 31. At this time, in a case where the offset amount X is 0 or a negative value, the distance (vertical distance) between the reference line L1 and the pressing portion tangent line L4 is defined as the intrusion amount Y of the pressing member 39 with respect to the intermediate transfer belt 31 (here, a positive value when the pressing portion tangent line L4 is located further on the outer peripheral surface side of the intermediate transfer belt 31 from the reference line L1). The intrusion amount Y can have 0 or a positive value.

Next, a case where the offset amount X is a positive value will be described. As illustrated in FIG. 20B, in the cross section substantially orthogonal to the rotational axis direction of the inner roller 32, a common tangent line of the outer roller 41 and the secondary pre-transfer roller 37 on the side on which the intermediate transfer belt 31 is suspended is defined as a reference line L1'. In addition, in the same cross section, a tangent line of the intermediate transfer belt 31 is defined as a pressing portion tangent line L4', the tangent line being substantially parallel to the reference line L1' and being in contact with the outer peripheral surface of the intermediate transfer belt 31 in the region in which the pressing member 39 is in contact with the intermediate transfer belt 31. At this time, in a case where the offset amount X is a positive value, the distance (vertical distance) between the reference line L1' and the pressing portion tangent line L4' is defined as the intrusion amount Y of the pressing member 39 with respect to the intermediate transfer belt 31 (here, a positive value when the pressing portion tangent line L4' is located further on the outer peripheral surface side of the intermediate transfer belt 31 from the reference line L1'). The intrusion amount Y can have 0 or a positive value.

As illustrated in FIGS. 20A and 20B, the intermediate transfer belt 31 is projected to the outer peripheral surface side by the pressing member 39 to increase the contact distance D. Therefore, the gap G between the intermediate transfer belt 31 and the recording material S in the vicinity of the inlet of the secondary transfer nip N2 can be reduced. Accordingly, "scattering" can be suppressed.

4. Problems and Outline of Configuration of Present Embodiment

For a wide variety of the recording materials S such as "thin paper" and "thick paper" which are different in stiffness, it can be considered that changing the offset amount X according to the type of the recording material S and providing the pressing member 39 configured to come into contact with the inner peripheral surface of the intermediate transfer belt 31 in the vicinity of the inlet of the secondary transfer nip N2 are effective in suppressing an image defect occurring in the vicinity of the secondary transfer nip N2 and forming a satisfactory image while obtaining satisfactory conveyance of the recording material S in the vicinity of the secondary transfer nip N2.

However, as illustrated in FIG. 20B, for example, in a case where the recording material S is "thin paper", when the offset amount X is increased and the intermediate transfer belt 31 is projected to the outer peripheral surface side by the pressing member 39, the contact distance D is too much increased, and an image defect, so-called "roughness" may occur in which the toner image is dynamically disturbed by friction between the toner image on the intermediate transfer belt 31 and the recording material S.

Therefore, in the present embodiment, the image forming apparatus 100 is configured such that when the offset amount X is changed to be large by changing the position of at least one of the inner roller 32 and the outer roller 41, the intrusion amount Y is changed such that the position of the pressing member 39 is changed to reduce the intrusion amount Y. Particularly, in the present embodiment, the image forming apparatus 100 is configured to change the position of the inner roller 32 to change the offset amount X. In addition, in the present embodiment, the image forming apparatus 100 is configured to change the offset amount X and the intrusion amount Y synchronously based on information regarding the type of the recording material S which is related to the stiffness of the recording material S.

For example, when the recording material S is "thick paper", the inner roller 32 is disposed at a first inner roller position at which the offset amount X is a first offset amount X1, and the pressing member 39 is disposed at a first pressing member position at which the intrusion amount Y is a first intrusion amount Y1. Then, for example, when the recording material S is "thin paper", the disposition is performed as follows. The inner roller 32 is disposed at a second inner roller position at which the offset amount X is a second offset amount X2 larger than the first offset amount X1, and the pressing member 39 is disposed at a second pressing member position at which the intrusion amount Y is a second intrusion amount Y2 smaller than the first intrusion amount Y1. The first offset amount X1 may be a positive value, 0, or a negative value, and the second offset amount X2 is typically a positive value. In addition, the first intrusion amount Y1 is a positive value, and the second intrusion amount Y2 may be 0 or a positive value.

Incidentally, changing the offset amount X and the intrusion amount Y synchronously refers to the following cases. Typically, in a case where an image is formed on the recording material S, when the offset amount X has been changed before the recording material S reaches the secondary transfer nip N2, the intrusion amount Y is also changed before the recording material reaches the secondary transfer nip N2. In addition, as another example, in a case where a predetermined adjusting operation such as applying a secondary transfer voltage, for example, to control the secondary transfer voltage, when the offset amount X has been changed before the start of the adjusting operation, the intrusion amount Y is also changed before the start of the adjusting operation. In addition, for example, a case where the recording material S is "thin paper" or "thick paper" refers to a case where in more detail, the "thin paper" or the "thick paper" passes through the secondary transfer nip N2.

5. Configuration Related to Secondary Transfer

A configuration related to secondary transfer in the present embodiment will be described in further detail. Here, for simplicity, as the information regarding the type of the recording material S which is related mainly to the stiffness of the recording material S, a case where basis weight information of paper as the recording material S is used will be described as an example. Then, it is assumed that "thin paper" is used as one example of the recording material S having a small stiffness and "thick paper" is used as one example of the recording material S having a large stiffness. However, as will be described later, the information regarding the type of the recording material S which is related to the stiffness of the recording material S is not limited to the basis weight information of the recording material S.

Figure 11A:
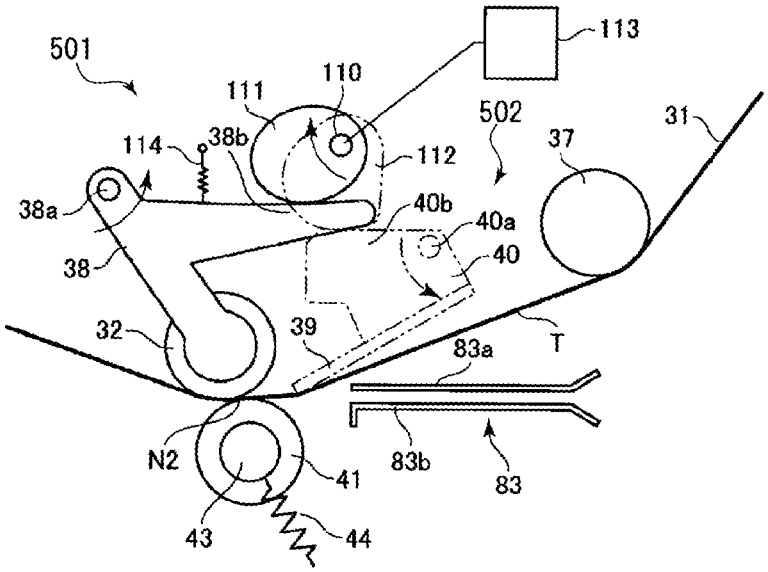
FIGS. 11A and 11B are schematic side views illustrating an offset mechanism and a pressing mechanism.
Figure 11B:
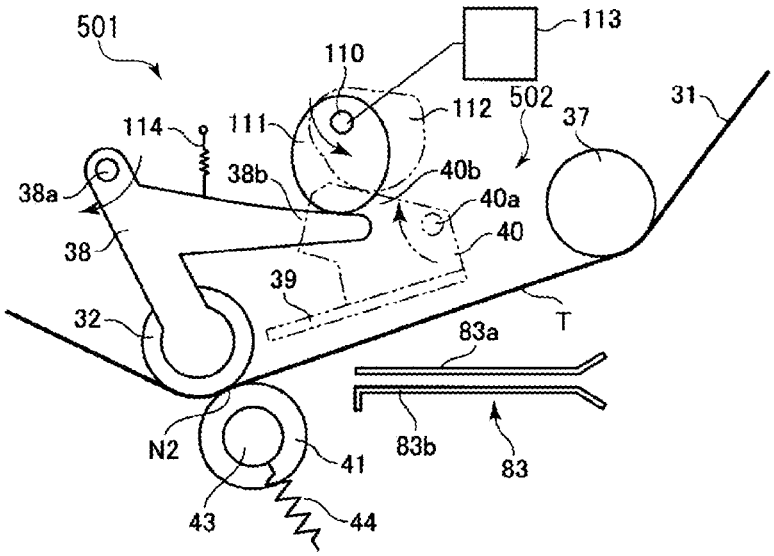
Figure 12A:
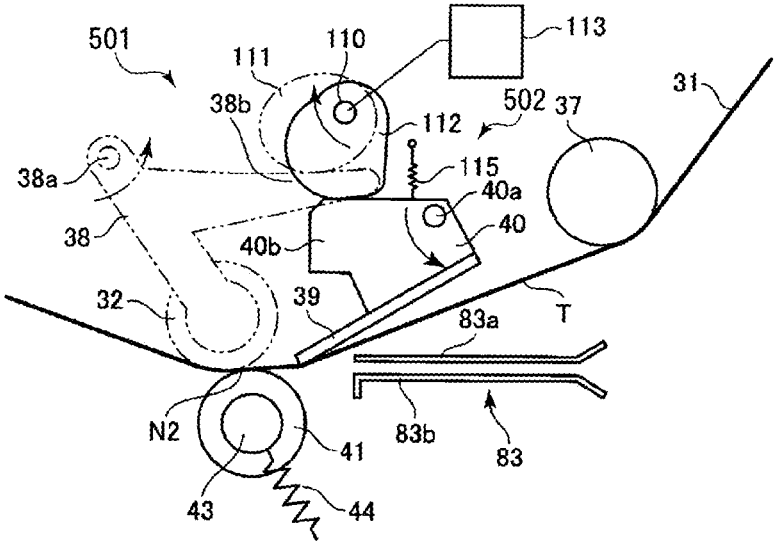
FIGS. 12A and 12B are schematic side views illustrating the offset mechanism and the pressing mechanism.
Figure 12B:
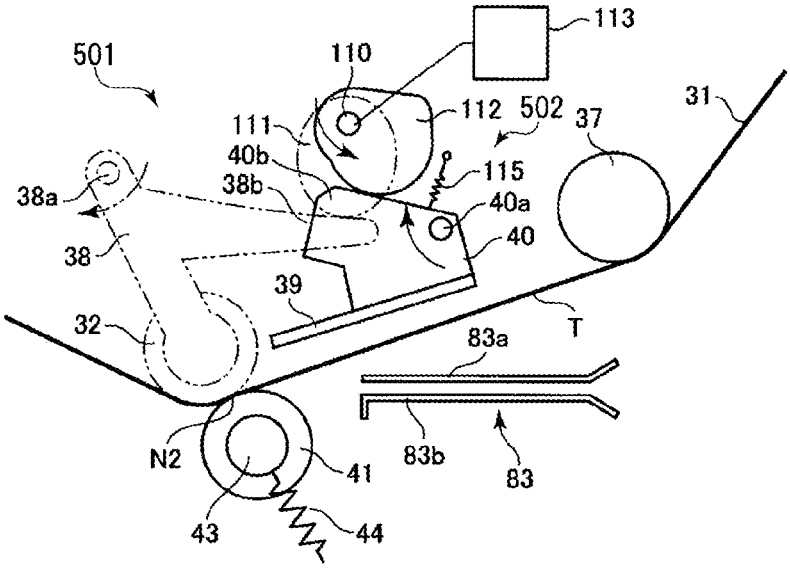

FIGS. 11A, 11B, 12A, and 12B are schematic side views of main parts as the vicinity of the secondary transfer nip N2 is viewed substantially in parallel to the rotational axis direction from one end portion side (foreground side of the drawing sheet of FIG. 10) in the rotational axis direction of the inner roller 32 in the present embodiment. FIGS. 11A and 11B are views for describing mainly the configuration and the operation of an offset mechanism 501 to be described later, and for ease of understanding, several configurations related to a pressing mechanism 502 to be described later are illustrated by alternate long and two short dashes lines. In addition, FIGS. 12A and 12B are views for describing mainly the configuration and the operation of the pressing mechanism 502 to be described later, and for ease of understanding, several configurations related to the offset mechanism 501 to be described later are illustrated by alternate long and two short dashes lines. FIGS. 11A and 11B illustrate a state in the case of "thick paper", and FIGS. 12A and 12B illustrate a state in the case of "thin paper".

5-1. Offset Mechanism

The offset mechanism 501 in the present embodiment will be described with reference to FIGS. 11A and 11B. In the present embodiment, the image forming apparatus 100 changes the relative position of the inner roller 32 with respect to a circumferential direction of the outer roller 41 to change the offset amount X, and includes the offset mechanism (offset amount changing portion) 501 as a first position changing mechanism. FIGS. 11A and 11B illustrate a configuration of one end portion in the rotational axis direction of the inner roller 32, and a configuration of the other end portion is the same (substantially symmetrical with respect to the center in the rotational axis direction of the inner roller 32).

Both end portions in the rotational axis direction of the inner roller 32 are rotatably supported by an inner roller holder 38 as a support member. The inner roller holder 38 is supported by the frame or the like of the intermediate transfer belt unit 30 so as to be turnable around a first turning shaft 38*a* as a center. In such a manner, the inner roller holder 38 turns around the first turning shaft 38*a* to turn the inner roller 32 around the first turning shaft 38*a*, so that the relative position of the inner roller 32 with respect to the outer roller 41 is changed, and thus the offset amount X can be changed.

The inner roller holder 38 is configured to be turned by the action of a first cam 111 as an operation member. The first cam 111 is supported by the frame or the like of the intermediate transfer belt unit 30 so as to be rotatable around a cam rotational shaft 110 as a center. In more detail, in the present embodiment, the cam rotational shaft 110 is rotatably supported by the frame or the like of the intermediate transfer belt unit 30, and the first cam 111 is fixed to the cam rotational shaft 110. The first cam 111 receives drive from a position change motor 113 as a driving source to be rotatable around the cam rotational shaft 110 as a center. In more detail, in the present embodiment, the cam rotational shaft 110 receives drive from the position change motor 113 to rotate, so that the first cam 111 fixed to the cam rotational shaft 110 rotates integrally with the cam rotational shaft 110. In addition, the first cam 111 is in contact with a first cam follower 38*b* provided in the inner roller holder 38. In addition, the inner roller holder 38 is biased by a first turning spring 114 to turn in a direction in which the first cam follower 38*b* engages with the first cam 111, the first turning spring 114 being formed of a tension spring or the like that is a biasing member (elastic member) as a biasing portion. Incidentally, the tension of the intermediate transfer belt 31 or pressing by the outer roller 41 may provide a sufficient momentum to turn the inner roller holder 38 in the direction in which the first cam follower 38*b* engages with the first cam 111. In this case, the first turning spring 114 may not be provided.

In such manner, in the present embodiment, the offset mechanism 501 includes the inner roller holder 38; the first cam 111; the cam rotational shaft 110; the position change motor 113; the first turning spring 114; and the like.

As illustrated in FIG. 11A, in the case of "thick paper", the first cam 111 is driven by the position change motor 113 to rotate clockwise. Accordingly, the inner roller holder 38 turns counterclockwise around the first turning shaft 38*a* as a center, and the relative position of the inner roller 32 with respect to the outer roller 41 is determined. Accordingly, the inner roller 32 is disposed at the first inner roller position at which the offset amount X is the first offset amount X1 that is relatively small. As a result, as described above, a decrease in image quality of a rear end portion in the conveyance direction of the "thick paper" can be suppressed.

In addition, as illustrated in FIG. 11B, in the case of "thin paper", the first cam 111 is driven by the position change motor 113 to rotate counterclockwise. Accordingly, the inner roller holder 38 turns clockwise around the first turning shaft 38*a* as a center, and the relative position of the inner roller 32 with respect to the outer roller 41 is determined. Accordingly, the inner roller 32 is disposed at the second inner roller position at which the offset amount X is the second offset amount X2 that is relatively large. As a result, as described above, the separability of the "thin paper" from the intermediate transfer belt 31 after the "thin paper" has passed through the secondary transfer nip N2 is improved.

5-2. Pressing Mechanism

The pressing mechanism 502 in the present embodiment will be described with reference to FIGS. 12A and 12B. In the present embodiment, the image forming apparatus 100 changes the position of the pressing member 39 to change the intrusion amount Yin synchronization with the operation of the offset mechanism 501 described above, and includes the pressing mechanism (intrusion amount changing portion) 502 as a second position changing mechanism. Particularly, in the present embodiment, the pressing mechanism 502 changes the position of the pressing member 39 to change the intrusion amount Y in connection with the operation of the offset mechanism 501 described above. FIGS. 12A and 12B illustrate a configuration of the one end portion in the rotational axis direction of the inner roller 32, and the configuration of the other end portion is the same (substantially symmetrical with respect to the center in the rotational axis direction of the inner roller 32).

In the present embodiment, the image forming apparatus 100 includes the pressing member (backup sheet) 39 having the same sheet shape as that of the pressing member described with reference to FIGS. 20A and 20B. The pressing member 39 presses the inner peripheral surface of the intermediate transfer belt 31 to cause the intermediate transfer belt 31 to project to the outer peripheral surface side in the vicinity of the inlet of the secondary transfer nip N2. The pressing member 39 is disposed to come into contact with the inner peripheral surface of the intermediate transfer belt 31 on an upstream side of the inner roller 32 and on a downstream side of the secondary pre-transfer roller 37 with respect to the rotational direction of the intermediate transfer belt 31. Particularly, in the present embodiment, the pressing member 39 is disposed to come into contact with the inner peripheral surface of the intermediate transfer belt 31 to correspond to a position upstream of the inner roller 32 and downstream of a downstream tip of the conveying guide 83 (first guide member 83*a*) with respect to the conveyance direction of the recording material S. The pressing member 39 can be made of a resin material. As the resin material forming the pressing member 39, a polyester resin such as a PET resin can be suitably used. In the present embodiment, the pressing member 39 is formed of a plate-shaped member having a predetermined length in each of a longitudinal direction disposed substantially parallel to a width direction of the intermediate transfer belt 31 (direction substantially orthogonal to the movement direction of the surface) and a lateral direction substantially orthogonal to the longitudinal direction, and having a predetermined thickness. The length of the pressing member 39 in the longitudinal direction is equal to the length of the intermediate transfer belt 31 in the width direction. Then, a free end portion of the pressing member 39 which is one end portion in the lateral direction of the pressing member 39 (downstream end portion in the rotational direction of the intermediate transfer belt 31) is capable of coming into contact with the inner peripheral surface of the intermediate transfer belt 31 over substantially the entire width of the intermediate transfer belt 31, and is capable of pressing the intermediate transfer belt 31. In addition, as one example, the thickness of the pressing member 39 is from 0.4 mm to 0.6 mm. For example, in a case where a PET resin sheet is used as the material of the pressing member 39, when a PET resin sheet having too low electrical resistance is used, there is a probability that as a secondary transfer voltage is applied to the outer roller 41, current flows to the pressing member 39 to cause a transfer defect. On the contrary, when a PET resin sheet having too high electrical resistance is used, there is a probability that friction between the pressing member 39 and the intermediate transfer belt 31 generates static electricity (frictional charging), the intermediate transfer belt 31 is attracted to the pressing member 39, and the rotation of the intermediate transfer belt 31 is interrupted. For this reason, it is preferable that a PET resin sheet having electrical resistance adjusted to medium resistance (for example, the volume resistivity is $1\times10^5$ to $1\times10^9$ Ω·cm) is used as the pressing member 39.

The pressing member 39 is supported by a pressing member holder 40 as a support member. A fixed end portion of the pressing member 39 which is one end portion in the lateral direction of the pressing member 39 (upstream end portion in the rotational direction of the intermediate transfer belt 31) is fixed to the pressing member holder 40 over substantially the entire width in the longitudinal direction. The pressing member holder 40 is supported by the frame or the like of the intermediate transfer belt unit 30 so as to be turnable around a second turning shaft 40*a* as a center. In such a manner, the pressing member holder 40 turns around the second turning shaft 40*a* to turn the pressing member 39 around the second turning shaft 40*a*, so that the position of the pressing member 39 is changed, and thus the intrusion amount Y can be changed.

The pressing member holder 40 is configured to be turned by the action of a second cam 112 as an operation member. The second cam 112 is rotatable coaxially with the first cam 111, which forms the offset mechanism 501 described above, in connection with the first cam 111. In more detail, in the present embodiment, the second cam 112 is fixed to the cam rotational shaft 110 that is rotatably supported by the frame or the like of the intermediate transfer belt unit 30. Then, in the present embodiment, the cam rotational shaft 110 receives drive from the position change motor 113 to rotate, so that the first cam 111 and the second cam 112 which are fixed to the cam rotational shaft 110 rotate. In addition, the second cam 112 is in contact with a second cam follower 40*b* provided in the pressing member holder 40. In addition, the pressing member holder 40 is biased by a second turning spring 115 to turn in a direction in which the second cam follower 40*b* engages with the second cam 112, the second turning spring 115 being formed of a tension spring or the like that is a biasing member (elastic member) as a biasing portion.

Here, the first cam 111 and the second cam 112 are provided to have respective fixed phases with respect to the cam rotational shaft 110 such that the first cam 111 and the second cam 112 move the inner roller 32 and the pressing member 39 in connection with each other in a predetermined relationship, respectively. Accordingly, the pressing mechanism 502 is capable of changing the intrusion amount Y in connection with the operation of the offset mechanism 501 described above. In such a manner, in the present embodiment, the offset amount X and the intrusion amount Y can be changed synchronously by one (common) driving source. Namely, in the present embodiment, the offset mechanism 501 and the pressing mechanism 502 can be driven by one (common) actuator. For this reason, the configuration of the apparatus can be simplified and the cost of the apparatus can be reduced.

In such manner, in the present embodiment, the pressing mechanism 502 includes the pressing member holder 40; the second cam 112; the cam rotational shaft 110; the position change motor 113; the second turning spring 115; and the like.

As illustrated in FIG. 12A, in the case of "thick paper", the second cam 112 is driven by the position change motor 113 to rotate clockwise in connection with that the inner roller 32 is disposed at the first inner roller position (first offset amount X1) by the offset mechanism 501. Accordingly, the pressing member holder 40 turns counterclockwise around the second turning shaft 40*a* as a center, and the pressing member 39 is disposed at the first pressing member position at which the intrusion amount Y is the first intrusion amount Y1 that is relatively large. In the present embodiment, at this time, a tip of the pressing member 39 abuts against the inner peripheral surface of the intermediate transfer belt 31 in the vicinity of the inlet of the secondary transfer nip N2 to cause the intermediate transfer belt 31 to project to the outer peripheral surface side (first intrusion amount Y1>0 mm). As a result, as described above, the contact distance D between the intermediate transfer belt 31 and the recording material S in the vicinity of the inlet of the secondary transfer nip N2 can be increased, so that "scattering" can be suppressed. In the present embodiment, in the case of the "thick paper", the vicinity of the inlet of the secondary transfer nip N2 is pressed by pressing member 39. As a result, the outer roller 41 and the intermediate transfer belt 31 come into contact with each other to form a nip in a region in which the intermediate transfer belt 31 is separated from the inner roller 32 on an upstream side of the secondary transfer nip N2 in the movement direction of the intermediate transfer belt 31. For this reason, as described above, the contact distance D between the intermediate transfer belt 31 and the recording material S in the vicinity of the inlet of the secondary transfer nip N2 can be increased, so that "scattering" can be suppressed.

In addition, as illustrated in FIG. 12B, in the case of "thin paper", the second cam 112 is driven by the position change motor 113 to rotate counterclockwise in connection with that the inner roller 32 is disposed at the second inner roller position (second offset amount X2) by the offset mechanism 501. Accordingly, the pressing member holder 40 turns clockwise around the second turning shaft 40*a* as a center, and the pressing member 39 is disposed at the second pressing member position at which the intrusion amount Y is the second intrusion amount Y2 that is relatively small. In the present embodiment, at this time, the tip of the pressing member 39 is separated from the inner peripheral surface of the intermediate transfer belt 31 (second intrusion amount Y2=0 mm).

Here, a case will be reviewed in which in a state where the pressing member 39 is disposed at the first pressing member position (first intrusion amount Y1) illustrated in FIG. 12A, the inner roller 32 is disposed at the second inner roller position (second offset amount X2) illustrated in FIG. 12B. The contact distance D in this case is even larger than the contact distance D in a state where as illustrated in FIG. 12A, the inner roller 32 is disposed at the first inner roller position (first offset amount X1) and the pressing member 39 is disposed at the first pressing member position (first intrusion amount Y1). For this reason, an image defect, so-called "roughness" occurs in which the toner image is dynamically disturbed by friction between the toner image on the intermediate transfer belt 31 and the recording material S. Meanwhile, in the present embodiment, as illustrated in FIG. 12B, the pressing member 39 is disposed at the second pressing member position (second intrusion amount Y2), particularly, at a position separated from the intermediate transfer belt 31 in synchronization with (particularly in the present embodiment, in connection with) that the inner roller 32 is disposed at the second inner roller position (second offset amount X2). Accordingly, the contact distance D is prevented from being larger than necessary, so that "roughness" can be suppressed.

Incidentally, in the present embodiment, the pressing member 39 is a sheet-shaped member made of resin, but is not limited thereto. The pressing member 39 may be a sheet-shaped member formed of, for example, a thin plate made of metal. In addition, the pressing member 39 may be, for example, an elastic member (pad-shaped member or the like) such as sponge or rubber. In addition, the pressing member 39 may be, for example, a rigid member such as a rotatable roller made of resin or metal. In addition, the pressing member 39 is not limited to being disposed at a predetermined position and abutting against the intermediate transfer belt 31 as in the present embodiment. For example, when the rigid member such as a rotatable roller is used as the pressing member 39, the pressing member 39 may be biased toward the intermediate transfer belt 31 by a spring or the like as a biasing portion.

5-3. Abutting and Separating Mechanism

Figure 13:
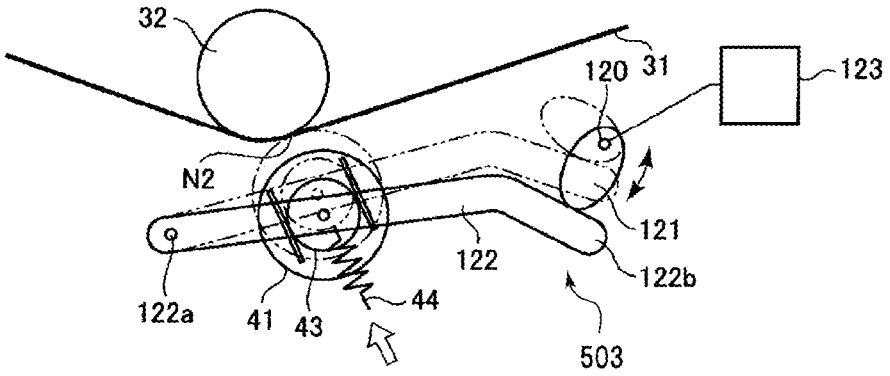
FIG. 13 is a schematic side view illustrating an abutting and separating mechanism of an outer roller.

An abutting and separating mechanism 503 of the outer roller 41 in the present embodiment will be described. FIG. 13 is a schematic view illustrating a schematic configuration of the abutting and separating mechanism 503. FIG. 13 illustrates a configuration of the one end portion in the rotational axis direction of the inner roller 32, and a configuration of the other end portion is the same (substantially symmetrical with respect to the center in the rotational axis direction of the inner roller 32).

Both end portions in the rotational axis direction of the outer roller 41 are rotatably supported by a bearing 43. The bearing 43 is supported by the frame or the like of the apparatus main body 100*a* so as to be movable in a sliding manner in the direction toward the inner roller 32 and in a direction opposite thereto along a predetermined direction (for example, a direction substantially orthogonal to the reference line L1 described above). The bearing 43 is pressed toward the inner roller 32 by the pressing spring 44 formed of a compression spring that is a biasing member (elastic member) as a biasing portion. Accordingly, the outer roller 41 abuts against the inner roller 32 with the intermediate transfer belt 31 interposed therebetween to form the secondary transfer nip N2.

Then, in the present embodiment, the image forming apparatus 100 includes the abutting and separating mechanism (abutting and separating portion) 503 configured to cause the outer roller 41 to abut against and separate from the intermediate transfer belt 31. As illustrated in FIG. 13, the abutting and separating mechanism 503 includes an arm 122; an abutting and separating cam 121; an abutting and separating motor 123; and the like. The arm 122 is supported by the frame or the like of the apparatus main body 100*a* so as to be turnable around an arm turning shaft 122*a* as a center, and engages with the bearing 43. In addition, the arm 122 is configured to be turned by the action of the abutting and separating cam 121 as an operation member. The abutting and separating cam 121 is supported by a frame or the like of the apparatus main body 100*a* so as to be rotatable around an abutting and separating rotational shaft 120 as a center. The abutting and separating cam 121 receives drive from the abutting and separating motor 123 as a driving source to be rotatable around the abutting and separating rotational shaft 120 as a center. In addition, the abutting and separating cam 121 is in contact with an abutting and separating cam follower 122*b* provided in the arm 122. In addition, the arm 122 is biased by the pressing spring 44 to turn in a direction in which the abutting and separating cam follower 122*b* engages with the abutting and separating cam 121.

The abutting and separating mechanism 503 moves the outer roller 41 in the direction away from and the direction toward the inner roller 32. As illustrated by a solid line in FIG. 13, when the outer roller 41 is separated from the intermediate transfer belt 31, the abutting and separating cam 121 is driven by the abutting and separating motor 123 to rotate, for example, counterclockwise, so that the arm 122 turns clockwise. Accordingly, the arm 122 moves the bearing 43 against the biasing force of the pressing spring 44 in the direction away (downward) from the inner roller 32, and the outer roller 41 is separated from the intermediate transfer belt 31. Meanwhile, as illustrated by an alternate long and two short dashes line in FIG. 13, when the outer roller 41 comes into contact with the intermediate transfer belt 31, the abutting and separating cam 121 is driven by the abutting and separating motor 123 to rotate, for example, clockwise, so that the arm 122 is turned counterclockwise by the biasing force of the pressing spring 44. Accordingly, the arm 122 moves the bearing 43 in the direction toward the inner roller 32 (upward), and the outer roller 41 abuts against the intermediate transfer belt 31.

In the present embodiment, in order to prevent the toner from adhering to the surface of the outer roller 41, the abutting and separating mechanism 503 separates the outer roller 41 from the intermediate transfer belt 31, the toner not being transferred on to a recording material S such as a test image (patch) for image density correction or color shift correction which is formed on the intermediate transfer belt 31. In addition, also when a treatment for a jam (paper jam) is performed, the abutting and separating mechanism 503 separates the outer roller 41 from the intermediate transfer belt 31. In addition, when the outer roller 41 continues to be pressed toward the inner roller 32 after a job (to be described later) has been ended, the inner roller 32 or the outer roller 41 may be deformed. Therefore, in the present embodiment, when the job is ended and the image forming apparatus 100 enters a standby state to wait for the next job, the abutting and separating mechanism 503 separates the outer roller 41 from the intermediate transfer belt 31. Also when the image forming apparatus 100 is in a sleep state (to be described later) or a main power supply is in an OFF state, the outer roller 41 maintains the state where the outer roller 41 is separated from the intermediate transfer belt 31.

Incidentally, in the present embodiment, an operation of changing the offset amount X using the offset mechanism 501 and changing the intrusion amount Y using the pressing mechanism 502 (here, also referred to simply as a "position change operation") may be performed in either of a state where the outer roller 41 is in contact with the intermediate transfer belt 31 and a state where the outer roller 41 is separated from the intermediate transfer belt 31. In addition, in the present embodiment, the position change operation may be performed in either of a state where the intermediate transfer belt 31 is stopped and a state where the intermediate transfer belt 31 rotates. From the viewpoint of reducing the wear of the intermediate transfer belt 31 or the outer roller 41, a driving load of the position change operation, or the like, it is effective to perform the position change operation in a state where the outer roller 41 is separated from the intermediate transfer belt 31. In this case, typically, the position change operation is performed in a state where the intermediate transfer belt 31 is stopped. Meanwhile, when the position change operation is performed in a state where the intermediate transfer belt 31 has rotated in a paper-to-paper step (to be described later), from the viewpoint of reducing the time taken for the position change operation, it is effective to perform the position change operation in a state where the outer roller 41 is in contact with the intermediate transfer belt 31.

5-4. Specific Examples of Offset Amount and Intrusion Amount

First Specific Example

In the present embodiment (first specific example), based on a basis weight M of the recording material S, the pattern of a combination of the offset amounts X (X1 and X2) and the intrusion amounts Y (Y1 and Y2) is set to, for example, the following two patterns.

(a) $M \geq 52$ g/m$^2$: X1=−1.3 mm and Y1=1.5 mm (b) $M < 52$ g/m$^2$: X2=2.5 mm and Y2=0 mm (separation)

As in the present embodiment, when the material of the pressing member 39 is resin, and particularly, the shape thereof is a sheet shape, it is preferable that the positions of the inner roller 32 and the pressing member 39 in the setting (b) are defined as home positions. This is to prevent creep deformation of the pressing member 39 caused by continuing to receive pressure by the tension of the intermediate transfer belt 31 for a long period of time. When the pressing member 39 is subjected to a creep change, there is a probability that the intrusion amount Y1, for example, in the case of "thick paper" is smaller than the above setting of 1.5 mm due to a change with time. Here, the home positions refer to positions when the image forming apparatus 100 is in a sleep state or the main power supply is in an OFF state.

Incidentally, in the present embodiment, the pressing member 39 is separable from the inner peripheral surface of the intermediate transfer belt 31, but is not limited thereto. When the intrusion amount Y is 0, the pressing member 39 may be in contact with the intermediate transfer belt 31. In addition, the second intrusion amount Y2 may be smaller than the first intrusion amount Y1, and the configuration may be such that the intrusion amount Y does not have 0. When the influence of creep deformation is sufficiently small or there is no creep deformation, for example, when the pressing member 39 is a rotatable roller formed of a thin plate made of metal, the configuration is easily adopted in which the intrusion amount Y does not have 0. For example, based on the basis weight M of the recording material S, the pattern of a combination of the offset amounts X (X1 and X2) and the intrusion amounts Y (Y1 and Y2) may be set to the following two patterns.

Second Specific Example (a) $M \geq 52$ g/m$^2$: X1=−1.3 mm and Y1=1.5 mm (b) $M < 52$ g/m$^2$: X2=2.5 mm and Y2=0.5 mm In addition, in the first and second specific examples, a case where the value of the intrusion amount Y1 is a constant value for each of the offset amounts X (X1 and X2) has been described as an example; however, the present invention is not limited thereto. For example, the configuration may be such that in each of the offset amounts X (X1 and X2), the intrusion amount Y is changed according to the basis weight. Specifically, the intrusion amount Y may be set as follows.

Third Specific Example (a)≥M 300 g/m$^2$: X1=−1.3 mm and Y1=1.5 mm (b) 52 g/m$^2$≤M<300 g/m$^2$: X1=−1.3 mm and Y1=0.5 mm (c) $M < 52$ g/m$^2$: X2=2.5 mm and Y2=0 mm (separation)

Fourth Specific Example (a) $M \geq 300$ g/m$^2$: X1=−1.3 mm and Y1=1.5 mm (b) 100 g/m$^2$≤M<300 g/m$^2$: X1=−1.3 mm and Y1=0.5 mm (c) 52 g/m$^2$≤M<100 g/m$^2$: X2=2.5 mm and Y2=0.1 mm (d) $M < 52$ g/m$^2$: X2=2.5 mm and Y2=0 mm (separation)

As in the fourth specific example, when the value of the intrusion amount Y1 is changed for each of the offset amounts X (X1 and X2), a relationship is established in which the maximum value (here, Y2=0.1 mm) of the intrusion amount Y set for the offset amount X2 (>0) is smaller than the minimum value (here, Y1=0.5 mm) of the intrusion amount Y set for the offset amount X1.

The offset amount X and the intrusion amount Y, and the type of the recording material S (here, the basis weight of the recording material S) assigned to a combination of the offset amount X and the intrusion amount Y are not limited to the above-described specific examples. From the viewpoint of improving the separability of the recording material S from intermediate transfer belt 31 or suppressing an image defect occurring in the vicinity of the secondary transfer nip N2 described above, the above variables can be appropriately set through experiments or the like. The offset amount X is, although not limited thereto, suitably from approximately −3 mm to +3 mm. In addition, the pressing member 39 is suitably disposed, although not limited thereto, to be capable of coming into contact with the inner peripheral surface of the intermediate transfer belt 31 within 25 mm upstream in the rotational direction of the intermediate transfer belt 31 from a region in which the inner roller 32 and the intermediate transfer belt 31 come into contact with each other. With such settings, good transferability can be obtained. In addition, the intrusion amount Y is, although not limited thereto, suitably approximately 3.5 mm or less. When the intrusion amount Y is larger than 3.5 mm, a load applied to a contact surface between the pressing member 39 and the intermediate transfer belt 31 increases. Therefore, there is a probability that the intermediate transfer belt 31 is unlikely to rotate smoothly.

In addition, in the present embodiment, a case where the offset amount X (the position of the inner roller 32) is switched between two steps has been described as an example; however, the present invention is not limited thereto. The offset amount X (the position of the inner roller 32) may be changeable in three or more steps or steplessly.

Incidentally, when the offset amount X can be changed in three or more steps, the configuration may not necessarily be such that as the offset amount X is increased, the intrusion amount Y is reduced. For example, when the change amount of the offset amount X is small, or when the offset amount X is changed in a negative range, a fluctuation in the contact distance D described above is small. In this case, the intrusion amount Y may not be necessarily reduced.

In addition, when there is a setting at which the intrusion amount Y is 0 among settings at which the offset amount X is changed in three or more steps, due to the same above-described reason, it is preferable that the setting is defined as a setting for the home positions. The setting may be a setting that is not used at the time of image forming but used only when the image forming apparatus 100 is in a sleep state or the main power supply is in an OFF state.

6. Control Mode

Figure 14:
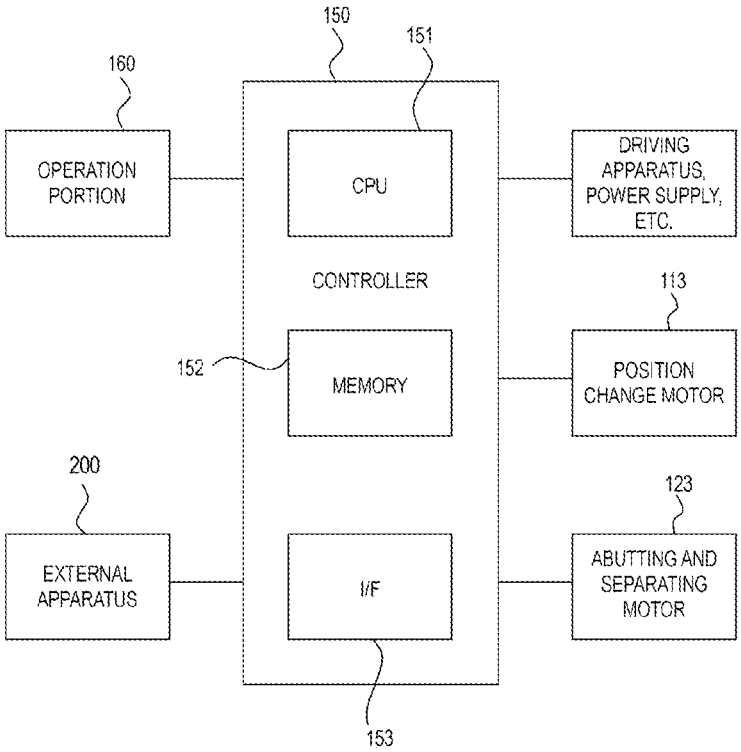
FIG. 14 is a schematic block diagram illustrating a control mode of main parts of the image forming apparatus.

FIG. 14 is a schematic block diagram illustrating a control mode of main parts of the image forming apparatus 100 of the present embodiment. A controller 150 as a control portion includes a CPU 151 as an arithmetic control portion that is a central component configured to perform arithmetic processing; a memory (storage medium) 152 such as a ROM and a RAM as a storage portion; an interface portion 153; and the like. The RAM that is a rewritable memory stores information input to the controller 150, detected information, arithmetic results, and the like, and the ROM stores a control program, data tables obtained in advance, and the like. The CPU 151 and the memory 152 are capable of transmitting or reading data to and from each other. The interface portion 153 controls the input and output (communication) of signals between the controller 150 and devices connected to the controller 150.

The parts (image forming portion 510, driving apparatuses for the members related to the conveyance of the intermediate transfer belt 31 and the recording material S, various power supplies, and the like) of the image forming apparatus 100 are connected to the controller 150. In relation to the present embodiment, particularly, the position change motor 113 that is the driving source of the offset mechanism 501 and the pressing mechanism 502, the abutting and separating motor 123 that is the driving source of the abutting and separating mechanism 503, and the like are connected to the controller 150. In addition, an operation portion (operation panel) 160 provided in the image forming apparatus 100 is connected to the controller 150. The operation portion 160 includes a display portion as a display unit configured to display information according to control of the controller 150, and an input portion as an input unit configured to input information to the controller 150 according to an operation by an operator such as a user or a service personnel. The operation portion 160 may be formed of a touch panel having the functions of the display portion and the input portion. In addition, an image reading apparatus (not illustrated) that is provided in the image forming apparatus 100 or is connected to the image forming apparatus 100, or an external apparatus 200 such as a personal computer connected to the image forming apparatus 100 may be connected to the controller 150.

The controller 150 controls the parts of the image forming apparatus 100 based on job information to form an image. The job information includes a start instruction (start signal) input from the operation portion 160 or the external apparatus 200, and information (command signal) regarding image forming conditions such as the type of the recording material S. In addition, the job information includes image information (image signal) input from the image reading apparatus or the external apparatus 200. Incidentally, information regarding the type of a recording material (also referred to simply as "information regarding the recording material") includes attributes based on general characteristics such as plain paper, woodfree paper, glossy paper, coated paper, embossed paper, thick paper, and thin paper (so-called paper type categories), and arbitrary information such as numerical values or numerical ranges such as basis weight, thickness, and size, or a brand (including manufacturer, part number, and the like) which can distinguish between recording materials. In the present embodiment, the information regarding the type of the recording material S includes information regarding the type of the recording material S which is related to the stiffness of the recording material S, particularly, as one example, basis weight information of the recording material S.

Here, the image forming apparatus 100 starts according to one start instruction, and executes a job that is a series of operations of forming an image on a single or a plurality of the recording materials S and outputting the single or the plurality of recording materials S. Generally, the job includes an image forming step (print operation); a pre-rotation step; the paper-to-paper step when an image is formed on the plurality of recording materials S; and a post-rotation step. The image forming step is a period in which the formation of an electrostatic image of an image that is to be formed on the recording material S and to be output, the formation of a toner image, and primary transfer and secondary transfer of the toner image are performed, and the time for image forming (image forming period) refers to this period. In more detail, the timing of image forming differs at positions at which steps for the formation of the electrostatic image, the formation of the toner image, and the primary transfer and the secondary transfer of the toner image are performed. The pre-rotation step is a period from the input of a start instruction to the actual start of image forming, in which a preparation operation is performed before the image forming step. The paper-to-paper step is a period corresponding to an interval between the recording material S and the recording material S when image forming continues to be performed on the plurality of recording materials S (continuous image forming). The post-rotation step is a period in which an arrangement operation (preparation operation) is performed before the image forming step. The time for non-image forming (non-image forming period) is a period other than the time for image forming, and includes the pre-rotation step; the paper-to-paper step; the post-rotation step; numerous pre-rotation steps that are preparation operations when the image forming apparatus 100 receives the supply of electric power or returns from a sleep state; and the like. Incidentally, the sleep state (hibernate state) is a state where, for example, the supply of electric power to each part of the image forming apparatus 100 other than the controller 150 (or a part thereof) is stopped and the electric power consumption is smaller than in a standby state. In the present embodiment, the above-described "position change operation" is executed at the time of non-image forming.

7. Control Procedure

Figure 15:
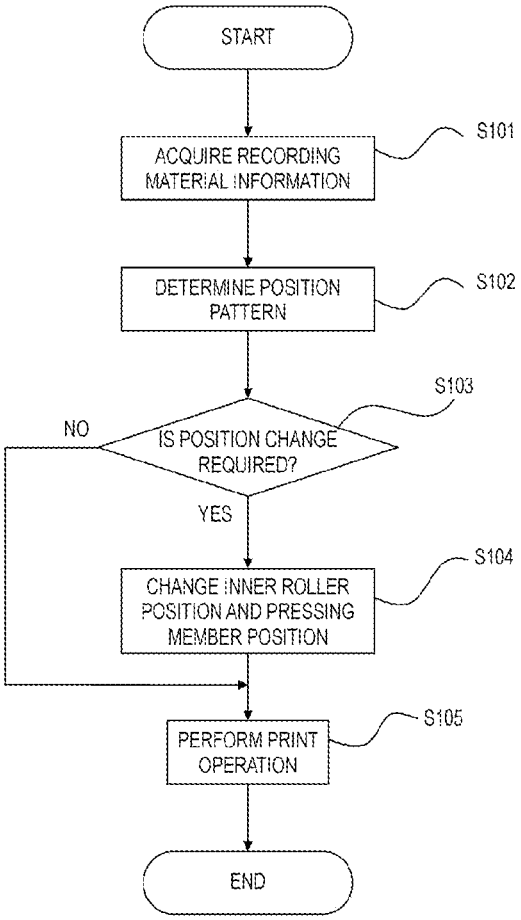
FIG. 15 is a flowchart illustrating an outline of an operation procedure of a job.

FIG. 15 is a flowchart illustrating an outline of a control procedure of a job in the present embodiment. Here, it is assumed that the types of the recording materials S used for image forming in one job are the same. In addition, here, a case where an operator causes the image forming apparatus 100 to execute a job from the external apparatus 200 will be described as an example. Incidentally, FIG. 15 illustrates the outline of the control procedure focusing on the position change operation, and numerous other operation normally required to execute the job and output an image are omitted.

When job information (image information, image forming condition information, and start instruction) is input from the external apparatus 200, the controller 150 acquires information regarding the type of the recording material S used for image forming, which is included in the job information (S101). In the present embodiment, the information regarding the type of the recording material S includes at least basis weight information of the recording material S. Incidentally, the controller 150 is capable of acquiring the information regarding the type of the recording material S, which is directly input (including selecting from a plurality of options) from the external apparatus 200 (or the operation portion 160) by an operation by the operator. In addition, the controller 150 is also capable of acquiring the information regarding the type of the recording material S based on information regarding the cassette 61, 62, or 63 that sends out the recording material S in the job, the information being input from the external apparatus 200 (or the operation portion 160) by an operation by the operator. In this case, the controller 150 is capable of acquiring the information regarding the type of the recording material S from the information regarding the type of the recording material S, which is stored in the memory 152 in association with the each of the cassettes 61, 62, and 63 in advance, the recording material S being stored in each of the cassettes 61, 62, and 63. Here, when the information regarding the type of the recording material S is registered, the corresponding information may be selected from a list of the types of the recording materials S stored in advance in the memory 152 or a storage apparatus that is connected to the controller 150 through a network.

The controller 150 determines a pattern of a combination of the position of the inner roller 32 (offset amount X) and the position of the pressing member 39 (intrusion amount Y) (here, also referred to simply as a "position pattern") based on the information regarding the type of the recording material S acquired in S101 (S102). Position pattern information according to the basis weight of the recording material S as in the specific examples described above is stored in the memory 152 in advance. Therefore, the controller 150 determines a position pattern from the position pattern information stored in the memory 152, based on the information regarding the type of the recording material S acquired in S101, the position pattern corresponding to the recording material S used in the current job.

As one specific example, in the present embodiment (first specific example), information regarding a predetermined threshold value (as one example, 52 g/m$^2$ described above) for the basis weight of the recording material S is stored in the memory 152. Then, when the basis weight of the recording material S used in the current job is the predetermined threshold value or more, the controller 150 determines, as the position pattern, the first inner roller position at which the offset amount X is the first offset amount X1 that is relatively small, and the first pressing member position at which the intrusion amount Y is the first intrusion amount Y1 that is relatively large. In addition, when the basis weight of the recording material S used in the current job is less than the predetermined threshold value, the controller 150 determines, as the position pattern, the second inner roller position at which the offset amount X is the second offset amount X2 that is relatively large, and the second pressing member position at which the intrusion amount Y is the second intrusion amount Y2 that is relatively small. Incidentally, as described above, when three or more position patterns are set, for example, information regarding a plurality of threshold values is set to define the range of the basis weight corresponding to each position pattern which is set such that the as the offset amount X is increased, the intrusion amount Y is reduced.

Next, the controller 150 determines whether or not a position pattern change with respect to the current position pattern of the inner roller 32 and the pressing member 39 is required, based on the position pattern determined in S102 (S103). Incidentally, as described above, in the present embodiment, the position pattern in which the offset amount X is the second offset amount X2 that is relatively large and the intrusion amount Y is the second intrusion amount Y2 that is relatively small are set to home positions. Therefore, for example, when the image forming apparatus 100 is in a sleep state after the previous job, regardless of a position pattern in the previous job, the position pattern is set to the home positions. The controller 150 is capable of acquiring current position pattern information of the inner roller 32 and the pressing member 39 from position pattern information stored in the memory 152 when the previous job is ended, information on whether or not the sleep state is entered, and the like.

When in S103, it is determined that the change is required, the controller 150 sends a control signal to the position change motor 113 to change the position (offset amount X) of the inner roller 32 and the position (intrusion amount Y) of the pressing member 39 ("position change operation") (S104). Meanwhile, when in S103, it is determined that the change is not required, the controller 150 causes the process to proceed to the process of S105 without changing the position (offset amount X) of the inner roller 32 and the position (intrusion amount Y) of the pressing member 39. Then, the controller 150 performs a print operation in the position pattern according to the recording material S used in the current job (S105). Incidentally, the position change operation is ended by the time the recording material S reaches the secondary transfer nip N2. As described above, the position change operation may be performed in either of a state where the outer roller 41 is in contact with the intermediate transfer belt 31 and a state where the outer roller 41 is separated therefrom. In addition, as described above, the position change operation may be performed in either of a state where the intermediate transfer belt 31 is stopped and a state where the intermediate transfer belt 31 rotates. When a job is started, typically, the outer roller 41 is separated from the intermediate transfer belt 31, and in a state where the intermediate transfer belt 31 is stopped, before the feeding of the recording material S is started, the position change operation is performed. In addition, for example, a plurality of types of the recording materials S are mixed in the recording material S used in one job, in the paper-to-paper step, the position change operation can be performed. In this case, typically, in a state where the outer roller 41 is in contact with the intermediate transfer belt 31 and the intermediate transfer belt 31 rotates, the position change operation is performed from when the preceding recording material S has completed passing through the secondary transfer nip N2 to when the subsequent recording material S reaches the secondary transfer nip N2.

8. Effects

As described above, according to the present embodiment, "scattering" in the case of "thick paper" can be suppressed while improving the separability of the recording material S from the intermediate transfer belt 31 and suppressing "roughness" in the case of "thin paper". Therefore, for a wide variety of the recording materials S, an image defect occurring in the vicinity of the secondary transfer nip N2 can be suppressed and a satisfactory image can be formed while obtaining satisfactory conveyance of the recording material S in the vicinity of the secondary transfer nip N2. Namely, satisfactory transfer performance for various recording materials S can be obtained.

Third Embodiment

Next, another embodiment of the present invention will be described. The basic configuration and the operation of the image forming apparatus of the present embodiment are the same as those of the image forming apparatus of the second embodiment. Therefore, in the image forming apparatus of the present embodiment, components having the same or corresponding functions or configurations as those of the image forming apparatus of the second embodiment are denoted by the same reference signs as those of the second embodiment, and a detailed description thereof will be omitted. In addition, in the present embodiment, similar to the second embodiment, a case where "thin paper" is used as one example of the recording material S having a small stiffness and "thick paper" is used as one example of the recording material S having a large stiffness will be described as an example.

In the second embodiment, the image forming apparatus 100 is configured to change the position of the inner roller 32 to change the offset amount X. Meanwhile, in the present embodiment, the image forming apparatus 100 is configured to change the position of the outer roller 41 to change the offset amount X.

Figure 16A:
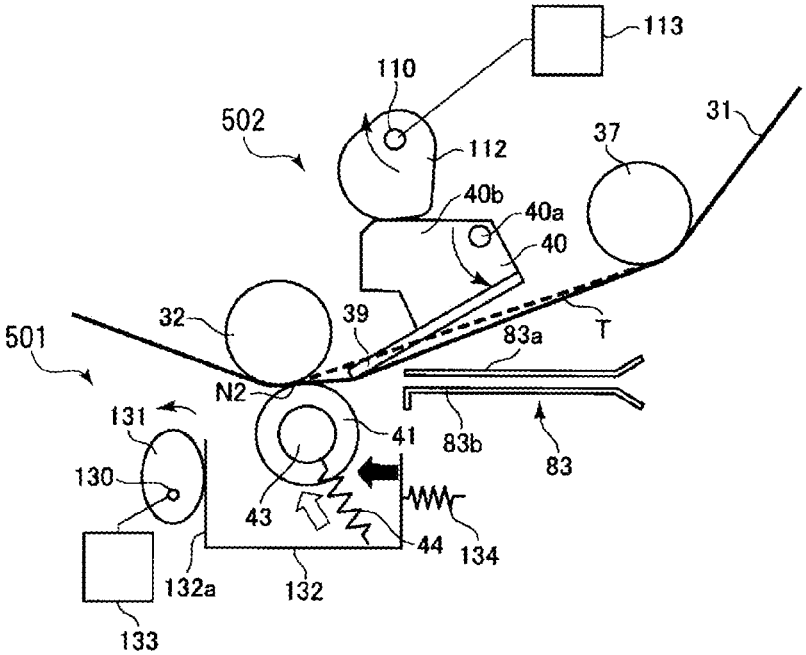
FIGS. 16A and 16B are schematic side views illustrating an offset mechanism and a pressing mechanism of another example.
Figure 16B:
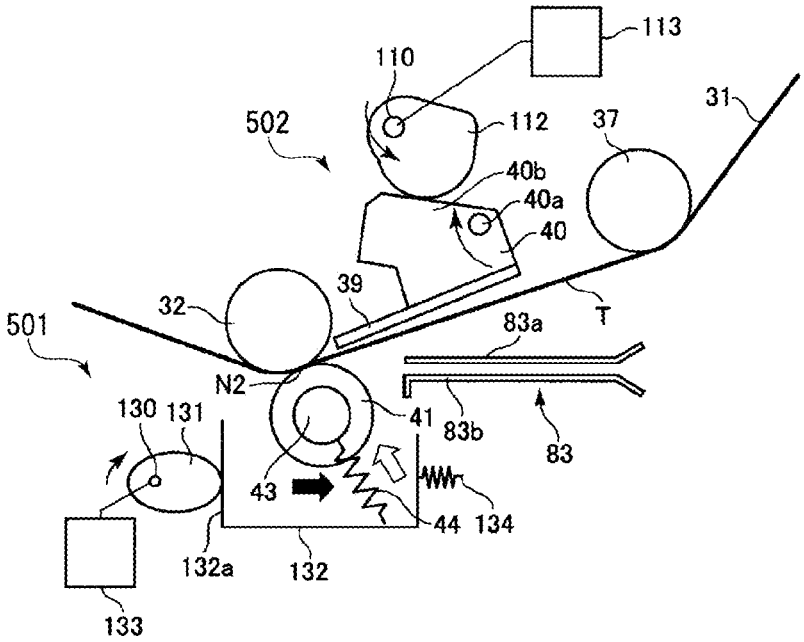

FIGS. 16A and 16B are schematic side views of main parts as the vicinity of the secondary transfer nip N2 is viewed substantially in parallel to the rotational axis direction from one end portion side (foreground side of the drawing sheet of FIG. 10) in the rotational axis direction of the inner roller 32 in the present embodiment. FIGS. 16A and 16B illustrate a configuration of the one end portion in the rotational axis direction of the inner roller 32, and the configuration of the other end portion is the same (substantially symmetrical with respect to the center in the rotational axis direction of the inner roller 32). FIG. 16A illustrates a state in the case of "thick paper", and FIG. 16B illustrates a state in the case of "thin paper".

In the present embodiment, similar to the second embodiment, the outer roller 41 is movable in a sliding manner in the direction toward the inner roller 32 (white arrow direction in FIGS. 16A and 16B) and in the direction opposite thereto along a predetermined first direction (for example, the direction substantially orthogonal to the reference line L1 described above). In addition, in the present embodiment, the outer roller 41 is movable in a sliding manner in a direction toward a downstream side in the conveyance direction of the recording material S (black arrow direction in FIG. 16A) and in a direction opposite thereto (black arrow direction in FIG. 16B) along a predetermined second direction (for example, a direction substantially parallel to the reference line L1 described above) that is independent from the first direction and intersects the first direction.

In the present embodiment, a support member 132 configured to support the bearing 43 of the outer roller 41 so as to be movable in a sliding manner along the first direction is supported by the frame or the like of the apparatus main body 100*a* so as to be movable in a sliding manner in the second direction. In addition, the support member 132 is configured to be movable in a sliding manner by the action of a third cam 131 as an operation member. The third cam 131 is supported by the frame or the like of the apparatus main body 100*a* so as to be rotatable around a third cam rotational shaft 130 as a center. The third cam 131 receives drive from an offset motor 133 as a driving source to be rotatable around the third cam rotational shaft 130 as a center. In addition, the third cam 131 is in contact with a third cam follower 132*a* provided in the support member 132. In addition, the support member 132 is biased by an offset spring 134 to be movable in a sliding manner in a direction in which the third cam follower 132*a* engages with the third cam 131, the offset spring 134 being formed of a compression spring or the like that is a biasing member (elastic member) as a biasing portion. In such manner, in the present embodiment, the offset mechanism 501 includes the support member 132; the third cam 131; the third cam rotational shaft 130; the offset motor 133; the offset spring 134; and the like.

Incidentally, in the present embodiment, similar to the second embodiment, the pressing mechanism 502 includes the pressing member holder 40; the second cam 112; a second cam rotational shaft (corresponding to the cam rotational shaft in the second embodiment) 110; a pressing motor (corresponding to the position change motor in the second embodiment) 113; and the like. In addition, in the present embodiment, the controller 150 sends control signals to the pressing motor 113 and the offset motor 133 to execute the position change operation. In such a manner, the offset mechanism 501 and the pressing mechanism 502 can be driven by separate actuators.

As illustrated in FIG. 16A, in the case of "thick paper", the third cam 131 is driven by the offset motor 133 to rotate, for example, counterclockwise. Then, the support member 132 moves in a sliding manner in the direction toward the downstream side in the conveyance direction of the recording material S (black arrow direction in the drawing) by the biasing force of the offset spring 134, and the relative position of the outer roller 41 with respect to the inner roller 32 is determined. Accordingly, the outer roller 41 is disposed at a first outer roller position at which the offset amount X is the first offset amount X1 that is relatively small. As a result, as described above in the second embodiment, a decrease in image quality of a rear end portion in the conveyance direction of the "thick paper" can be suppressed. In addition, similar to the second embodiment, the pressing mechanism 502 operates synchronously with the operation of the offset mechanism 501, and the pressing member 39 is disposed at the first pressing member position at which the intrusion amount Y is the first intrusion amount Y1 that is relatively large. In the present embodiment, at this time, a tip of the pressing member 39 abuts against the inner peripheral surface of the intermediate transfer belt 31 in the vicinity of the inlet of the secondary transfer nip N2 to cause the intermediate transfer belt 31 to project to the outer peripheral surface side (first intrusion amount Y1>0 mm). As a result, as described in the second embodiment, "scattering" can be suppressed.

In addition, as illustrated in FIG. 16B, in the case of "thin paper", the third cam 131 is driven by the offset motor 133 to rotate, for example, clockwise. Then, the support member 132 moves in a sliding manner in a direction toward the upstream side in the conveyance direction of the recording material S (black arrow in the drawing) against the biasing of the offset spring 134, and the relative position of the outer roller 41 with respect to the inner roller 32 is determined. Accordingly, the outer roller 41 is disposed at a second outer roller position at which the offset amount X is the second offset amount X2 that is relatively large. As a result, as described above in the second embodiment, the separability of the "thin paper" from the intermediate transfer belt 31 after the "thin paper" has passed through the secondary transfer nip N2 is improved. In addition, similar to the second embodiment, the pressing mechanism 502 operates synchronously with the operation of the offset mechanism 501, and the pressing member 39 is disposed at the second pressing member position at which the intrusion amount Y is the second intrusion amount Y2 that is relatively small. In the present embodiment, at this time, the tip of the pressing member 39 is separated from the inner peripheral surface of the intermediate transfer belt 31 (second intrusion amount Y2=0 mm).

Here, a case will be reviewed in which in a state where the pressing member 39 is disposed at the first pressing member position (first intrusion amount Y1) illustrated in FIG. 16A, the outer roller 41 is disposed at the second outer roller position (second offset amount X2) illustrated in FIG. 16B. In this case, the distance between the pressing member 39 and the outer roller 41 is short, and the intermediate transfer belt 31 and the recording material S are nipped between the pressing member 39 and the outer roller 41. Accordingly, an image defect, so-called "roughness" occurs in which the toner image is disturbed by frictional force before the recording material S rushes to the secondary transfer nip N2. Meanwhile, in the present embodiment, as illustrated in FIG. 16B, the pressing member 39 is disposed at the second pressing member position (second intrusion amount Y2), particularly, at a position separated from the intermediate transfer belt 31 in synchronization with that the outer roller 41 is disposed at the second outer roller position (second offset amount X2). Accordingly, the intermediate transfer belt 31 and the recording material S are not nipped between the outer roller 41 and the pressing member 39, so that "roughness" can be suppressed.

Incidentally, similar to that described in the second embodiment, the pressing member 39 is not limited to a sheet-shaped member, and the setting of the offset amount X or the intrusion amount Y is also not limited to that in the present embodiment.

As described above, with the configuration of the present embodiment, the same effects as those in the second embodiment can also be obtained. However, in the present embodiment, since the movability of the outer roller 41 in two directions is required, it can be said that the configuration of the second embodiment is more effective in simplifying the configuration of the apparatus and reducing the size of the apparatus than the configuration of the present embodiment.

Fourth Embodiment

Next, another embodiment of the present invention will be described. The basic configuration and the operation of the image forming apparatus of the present embodiment are the same as those of the image forming apparatus of the second embodiment. Therefore, in the image forming apparatus of the present embodiment, components having the same or corresponding functions or configurations as those of the image forming apparatus of the second embodiment are denoted by the same reference signs as those of the second embodiment, and a detailed description thereof will be omitted.

In the second embodiment, as an outer member that forms, together with the inner roller 32 as an inner member, the secondary transfer nip N2, the outer roller 41 directly abuts against the outer peripheral surface of the intermediate transfer belt 31 is used. Meanwhile, in the present embodiment, the outer roller as an outer member and a secondary transfer belt tensioned by the outer roller and other rollers are used.

Figure 17:
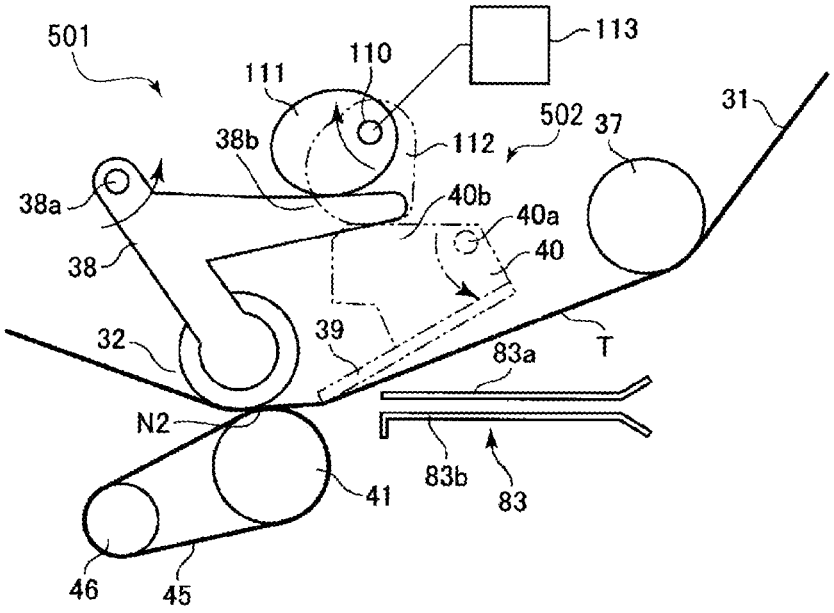
FIG. 17 is a schematic side view illustrating another example of an outer member.

FIG. 17 is a schematic side view of main parts as the vicinity of the secondary transfer nip N2 is viewed substantially in parallel to the rotational axis direction from one end portion side (foreground side of the drawing sheet of FIG. 10) in the rotational axis direction of the inner roller 32 in the present embodiment. In the present embodiment, the image forming apparatus 100 includes a tension roller 46 and the outer roller 41 as outer members and a secondary transfer belt 45 tensioned between these rollers. Then, the outer roller 41 abuts against the outer peripheral surface of the intermediate transfer belt 31 via the secondary transfer belt 45. Namely, the intermediate transfer belt 31 and the secondary transfer belt 45 are nipped between the inner roller 32 in contact with the inner peripheral surface of the intermediate transfer belt 31 and the outer roller 41 in contact with an inner peripheral surface of the secondary transfer belt 45, so that the secondary transfer nip N2 is formed. In the present embodiment, a contact portion between the intermediate transfer belt 31 and the secondary transfer belt 45 is the secondary transfer nip N2 as a secondary transfer portion.

Also in the present embodiment, similar to the second embodiment, the offset amount X is defined by the relative position between the inner roller 32 and the outer roller 41. In addition, similar to the second embodiment, the intrusion amount Y is also defined using the reference line L1 and the pressing portion tangent line L4 formed by the inner roller 32 and the secondary pre-transfer roller 37, or the reference line L1' and the pressing portion tangent line L4' formed by the outer roller 41 and the secondary pre-transfer roller 37. In addition, the configurations and the operation of the offset mechanism 501 and the pressing mechanism 502 in the present embodiment are the same as those in the second embodiment. In addition, also in the present embodiment, similar to the second embodiment, the abutting and separating mechanism 503 may be provided which moves the outer roller 41 in the direction away from and the direction toward the inner roller 32 to cause the secondary transfer belt 45 to abut against and separate from the intermediate transfer belt 31.

Incidentally, when the outer roller as an outer member and the secondary transfer belt tensioned by the outer roller and other rollers are used as in the present embodiment, similar to the third embodiment, the offset amount X can be changed by changing the position of the outer member with respect to the inner roller 32.

As described above, with the configuration of the present embodiment, the same effects as those in the second and third embodiments can also be obtained. In addition, in the present embodiment, the conveyance of the recording material S passing through the secondary transfer nip N2 can be improved.

[Others]

The present invention has been described above according to the specific embodiments; however, the present invention is not limited to the above-described embodiments.

In the above-described embodiments, the basis weight information of the recording material has been used as the information regarding the type of the recording material which is related to the stiffness of the recording material; however, the present invention is not limited thereto. When paper type categories (for example, paper type categories based on surface properties such as plain paper and coated paper) or brands (including manufacturer, product number, and the like) are the same, the basis weight of the recording material and the thickness of the recording material are in a substantially proportional relationship in many cases (the larger the thickness is, the larger the basis weight is). In addition, when paper type categories or brands are the same, the stiffness of the recording material and the basis weight or thickness of the recording material is in a substantially proportional relationship in many cases (the larger the basis weight or thickness is, the larger the stiffness is). Therefore, for example, for each paper type category, each brand, or each combination of a paper type category and a brand, the position pattern (pattern of a combination of the offset amount and the intrusion amount) can be set based on the basis weight, thickness, or stiffness of the recording material. Then, the controller enables the offset mechanism and the pressing mechanism to operate synchronously such that the position pattern according to the recording material is set, based on information such as the paper type category and the brand and information such as the basis weight, the thickness, and the stiffness of the recording material, which are input from the operation portion or the external apparatus. In addition, for example, quantitative information such as the basis weight, thickness, or stiffness of the recording material is not limited to being used as the information regarding the type of the recording material. For example, only qualitative information such as the paper type category, the brand, or a combination of the paper type category and the brand can be used as the information regarding the type of the recording material. For example, the position pattern is set according to the paper type category, the brand, or a combination of the paper type category and the brand, and the controller is capable of determining the position pattern according to information such as the paper type category and the brand input from the operation portion, the external apparatus, or the like. Also in this case, the position pattern is assigned based on a difference in stiffness between the recording materials. Incidentally, the stiffness of the recording material can be represented by Gurley stiffness (MD/long grain) [mN], and can be measured with a commercially available Gurley stiffness tester. For example, in the above-described embodiments, as a recording material having a threshold value of less than 52 g/m$^2$ for the basis weight, there is "thin paper" having a Gurley stiffness (MD) of approximately 0.3 mN as one example. In addition, in the above-described embodiments, as a recording material having a threshold value of 52 g/m$^2$ or for the basis weight, there are "plain paper" (basis weight of approximately 80 g/m$^2$) having a Gurley stiffness (MD) of approximately 2 mN as one example, and "thick paper" (basis weight of approximately 200 g/m$^2$) having a Gurley stiffness (MD) of approximately 20 mN as one example.

In addition, in the above-described embodiments, the controller has been described as acquiring the information regarding the type of the recording material based on an input from the operation portion or the external apparatus by an operation by the operator, but may acquire the information regarding the type of the recording material based on the input of a detection result of a detection portion configured to detect the information regarding the type of the recording material. For example, a basis weight sensor can be used as a basis weight detection portion configured to detect an index value correlating with the basis weight of the recording material. For example, a basis weight sensor using the attenuation of ultrasonic waves is known as the basis weight sensor. This basis weight sensor includes an ultrasonic wave generating portion and an ultrasonic wave receiving portion that are disposed to interpose a conveyance path of the recording material therebetween. Then, in the basis weight sensor, ultrasonic waves that have been generated from the ultrasonic wave generating portion, have transmitted through the recording material, and have been attenuated are received by the ultrasonic wave receiving portion, and an index value correlating with the basis weight of the recording material is detected based on the attenuation amount of the ultrasonic waves. Incidentally, the basis weight detection portion may be any type as long as being capable of detecting an index value correlating with the basis weight of the recording material, and is not limited to using ultrasonic waves, and may use, for example, light. In addition, the index value correlating with the basis weight of the recording material is not limited to the basis weight itself, and may be a thickness corresponding to the basis weight. In addition, a surface property sensor can be used as a smoothness detection portion configured to detect an index value correlating with the smoothness of the surface of the recording material, which can be used to detect the paper type category. As the surface property sensor, a specular and diffused reflection light sensor is known in which the recording material is irradiated with light and the intensities of specularly reflected light and diffusely reflected light are read by a light quantity sensor. When the surface of the recording material is smooth, specularly reflected light is strong, and when the surface is rough, diffusely reflected light is strong. For this reason, the surface property sensor is capable of detecting an index value correlating with the smoothness of the surface of the recording material by measuring a specularly reflected light quantity and a diffusely reflected light quantity. Incidentally, the smoothness detection portion may be any type as long as being capable of detecting an index value correlating with the smoothness of the surface of the recording material, and is not limited to using the above light quantity sensor, and may use, for example, an image pickup element. The index value correlating with the smoothness of the surface of the recording material is not limited to a value such as Bekk smoothness conforming to a predetermined standard, and may be a value having a correlation with the smoothness of the surface of the recording material. For example, these detection portions can be disposed adjacent to the conveyance path of the recording material, which is located upstream of the registration roller with respect to the conveyance direction of the recording material. In addition, for example, a sensor may be used in which the basis weight sensor, the surface property sensor, and the like are configured as one unit (media sensor).

In addition, in the above-described embodiments, as each of the offset mechanism, the pressing mechanism, and the abutting and separating mechanism, an actuator is used in which a movable portion is operated by a cam; however, the present invention is not limited thereto. Each of the offset mechanism, the pressing mechanism, and the abutting and separating mechanism may be any type as long as being capable of realizing the operation according to the above-described embodiments, and for example, an actuator may be used in which a movable portion is operated by a solenoid.

In addition, in the above-described embodiments, the configuration has been described in which either of the inner roller and the outer roller is moved; however, the offset amount may be changed by moving both the inner roller and the outer roller.

In addition, in the above-described embodiments, the case has been described in which the image bearing member having a belt shape is the intermediate transfer belt; however, the present invention is applicable as long as the image bearing member is formed of an endless belt configured to convey a toner image that is borne at an image forming position. As such an image bearing member having a belt shape, a photosensitive belt or an electrostatic recording dielectric belt other than the intermediate transfer belt in the above-described embodiments can be provided as an example.

In addition, the present invention can also be implemented in another embodiment in which a part or the entirety of the configurations of the above-described embodiments is replaced with an alternative configuration. Therefore, as long as the image forming apparatus uses the image bearing member having a belt shape, the present invention can be implemented without distinction of a tandem type and a one drum type, a charging method, an electrostatic image forming method, a developing method, a transfer method, and a fixing method. In the above-described embodiments, the main parts related to the formation and transfer of a toner image has been mainly described; however, the present invention can be implemented in various applications such as printers, various printing machines, copying machines, faxes, and multi-functional machines in addition to necessary devices, equipment, and housing structures.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus comprising:

a rotatable endless intermediate transfer belt configured to convey a toner image;

a plurality of tension rollers configured to tension the belt, and including an inner roller and an upstream roller that is disposed adjacent to the inner roller on an upstream side of the inner roller with respect to a rotational direction of the belt;

an outer roller contacting an outer peripheral surface of the belt and configured to form a transfer portion, where the toner image is transferred from the belt onto a recording material, by nipping said intermediary transfer belt between itself and the inner roller;

a position changing mechanism configured to change a position of the inner roller, and change a position of the transfer portion; and a controller configured to control the position changing mechanism, wherein in a cross section substantially orthogonal to a rotational axis direction of the inner roller, a common tangent line of the inner roller and the upstream roller on a side on which the belt is suspended is defined as a reference line L1, a straight line passing through a rotation center of the inner roller and being substantially orthogonal to the reference line L1 is defined as an inner roller center line L2, a straight line passing through a rotation center of the outer roller and being substantially orthogonal to the reference line L1 is defined as an outer roller center line L3, and a distance between the inner roller center line L2 and the outer roller center line L3 is defined as an offset amount X (here, a positive value when the outer roller center line L3 is located upstream of the inner roller center line L2 in the rotational direction of the belt), the controller controls the position changing mechanism to set a position at which the offset amount X has a positive value in the case of a first recording material, and controls the position changing mechanism to set a position at which the offset amount X has a negative value in the case of a second recording material having a thickness larger than a thickness of the first recording material.

2. The image forming apparatus according to claim 1, further comprising:

a pressing member configured to come into contact with an inner peripheral surface of the belt on the upstream side of the inner roller and on a downstream side of the upstream roller with respect to a rotational direction of the belt, and press the belt from an inner peripheral surface side to an outer peripheral surface side, wherein the pressing member is configured to press the belt when the offset amount X has a negative value, and the belt is pressed by the pressing member, so that a second region in which the belt and the outer roller are in contact with each other is formed upstream of a first region, in which the belt and the inner roller are in contact with each other, in the rotational direction of the belt.

3. The image forming apparatus according to claim 2, wherein the pressing member is configured to separate from the belt when the offset amount X has a positive value.

4. An image forming apparatus comprising:

a rotatable endless intermediate transfer belt configured to convey a toner image;

a plurality of tension rollers configured to tension the belt, and including an inner roller and an upstream roller that is disposed adjacent to the inner roller on an upstream side of the inner roller with respect to a rotational direction of the belt;

an outer roller contacting an outer peripheral surface of the belt and configured to form a transfer portion, where the toner image is transferred from the belt onto a recording material, by nipping said intermediary transfer belt between itself and the inner roller;

a pressing member configured to come into contact with an inner peripheral surface of the belt on the upstream side of the inner roller and on a downstream side of the upstream roller with respect to a rotational direction of the belt, and press the belt from an inner peripheral surface side to an outer peripheral surface side;

a first position changing mechanism configured to change a position of the inner roller, and change a position of the transfer portion;

a second position changing mechanism configured to change a position of the pressing member; and a controller configured to control the first position changing mechanism and the second position changing mechanism, wherein in a cross section substantially orthogonal to a rotational axis direction of the inner roller, a common tangent line of the inner roller and the upstream roller on a side on which the belt is suspended is defined as a reference line LL a straight line passing through a rotation center of the inner roller and being substantially orthogonal to the reference line L1 is defined as an inner roller center line L2, a straight line passing through a rotation center of the outer roller and being substantially orthogonal to the reference line L1 is defined as an outer roller center line L3, and a distance between the inner roller center line L2 and the outer roller center line L3 is defined as an offset amount X (here, a positive value when the outer roller center line L3 is located upstream of the inner roller center line L2 in the rotational direction of the belt), the controller controls the second position changing mechanism such that when the offset amount X is a first offset amount X1, the pressing member presses the inner peripheral surface of the belt, and when the offset amount X is a second offset amount X2 (>0) larger than the first offset amount X1, the pressing member separates from the inner peripheral surface of the belt.

5. The image forming apparatus according to claim 4, wherein when the offset amount X is the first offset amount X1, an intrusion amount Y of the pressing member with respect to the belt is changeable.

6. An image forming apparatus comprising:

a rotatable endless intermediate transfer belt configured to convey a toner image;

a plurality of tension rollers configured to tension the belt, and including an inner roller and an upstream roller that is disposed adjacent to the inner roller on an upstream side of the inner roller with respect to a rotational direction of the belt;

an outer roller contacting an outer peripheral surface of the belt and configured to form a transfer portion, where the toner image is transferred from the belt onto a recording material, by nipping said intermediary transfer belt between itself and the inner roller;

a pressing member configured to come into contact with an inner peripheral surface of the belt on the upstream side of the inner roller and on a downstream side of the upstream roller with respect to a rotational direction of the belt, and press the belt from an inner peripheral surface side to an outer peripheral surface side;

a first position changing mechanism configured to change a position of the inner roller, and change a position of the transfer portion;

a second position changing mechanism configured to change a position of the pressing member; and a controller configured to control the first position changing mechanism and the second position changing mechanism, wherein in a cross section substantially orthogonal to a rotational axis direction of the inner roller, a common tangent line of the inner roller and the upstream roller on a side on which the belt is suspended is defined as a reference line L1, a straight line passing through a rotation center of the inner roller and being substantially orthogonal to the reference line L1 is defined as an inner roller center line L2, a straight line passing through a rotation center of the outer roller and being substantially orthogonal to the reference line L1 is defined as an outer roller center line L3, and a distance between the inner roller center line L2 and the outer roller center line L3 is defined as an offset amount X (here, a positive value when the outer roller center line L3 is located upstream of the inner roller center line L2 in the rotational direction of the belt), the controller controls the second position changing mechanism such that when the offset amount X is a first offset amount X1, an intrusion amount Y of the pressing member with respect to the belt is set to a first intrusion amount Y1, and when the offset amount X is a second offset amount X2 (>0) larger than the first offset amount X1, the intrusion amount Y is smaller than the first intrusion amount Y1.

7. The image forming apparatus according to claim 6, wherein when the offset amount X is the first offset amount X1, the intrusion amount Y is changeable, and the controller controls the second position changing mechanism such that the intrusion amount Y set when the offset amount X is the second offset amount X2 is smaller than a minimum value of the intrusion amount Y set when the offset amount X is the first offset amount X1.

8. The image forming apparatus according to claim 4, wherein the first offset amount X1 is a negative value.

9. The image forming apparatus according to claim 4, further comprising:

an input portion configured to input information regarding the recording material, wherein the controller controls the first position changing mechanism and the second position changing mechanism based on the information regarding the recording material which is input by the input portion.

10. The image forming apparatus according to claim 9, wherein the controller controls the first position changing mechanism such that when a basis weight of the recording material is a first basis weight, the offset amount X is the first offset amount X1, and when the basis weight of the recording material is a second basis weight smaller than the first basis weight, the offset amount X is the second offset amount X2, based on basis weight information of the recording material which is input by the input portion.

11. The image forming apparatus according to claim 9, wherein the controller controls the first position changing mechanism such that when a thickness of the recording material is a first thickness, the offset amount X is the first offset amount X1, and when the thickness of the recording material is a second thickness smaller than the first thickness, the offset amount X is the second offset amount X2, based on thickness information of the recording material which is input by the input portion.

12. The image forming apparatus according to claim 9, wherein the controller controls the first position changing mechanism such that when a stiffness of the recording material is a first stiffness, the offset amount X is the first offset amount X1, and when the stiffness of the recording material is a second stiffness smaller than the first stiffness, the offset amount X is the second offset amount X2, based on stiffness information of the recording material which is input by the input portion.

13. The image forming apparatus according to claim 9, wherein the controller controls the first position changing mechanism such that when a category of the recording material is a first category, the offset amount X is the first offset amount X1, and when the category of the recording material is a second category having a stiffness smaller than a stiffness of the recording material of the first category, the offset amount X is the second offset amount X2, based on category information of the recording material which is input by the input portion.

14. The image forming apparatus according to claim 9, wherein the controller controls the first position changing mechanism such that when a brand of the recording material is a first brand, the offset amount X is the offset amount X1, and when the brand of the recording material is a second brand having a stiffness smaller than a stiffness of the recording material of the first brand, the offset amount X is the second offset amount X2, based on brand information of the recording material which is input by the input portion.

15. The image forming apparatus according to claim 4, wherein the outer roller directly abuts against the outer peripheral surface of the belt.

16. The image forming apparatus according to claim 4, wherein the outer roller abuts against the outer peripheral surface of the belt via another endless belt tensioned by the outer roller and another roller.

17. The image forming apparatus according to claim 4, wherein when the image forming apparatus is in a sleep state or a main power supply is turned off, the position of the pressing member is set to a position when the offset amount is the second offset amount X2.

18. The image forming apparatus according to claim 4, wherein the first position changing mechanism changes the position of the inner roller to change the relative position between the inner roller and the outer roller with respect to the circumferential direction of the inner roller.

19. The image forming apparatus according to claim 18, wherein the first position changing mechanism and the second position changing mechanism are driven by one driving source.

20. The image forming apparatus according to claim 19, further comprising:

a turnable first support member configured to support the inner roller and a first cam configured to turn the first support member, which form the first position changing mechanism;

a turnable second support member configured to support the pressing member and a second cam configured to turn the second support member, which form the second position changing mechanism; and a rotatable rotational shaft to which the first and second cams are fixed and which form the first and second position changing mechanisms, wherein the driving source generates a driving force to rotate the rotational shaft.

21. The image forming apparatus according to claim 4, wherein a guide member configured to guide the recording material to the transfer portion is provided upstream of the transfer portion with respect to a conveyance direction of the recording material.

22. The image forming apparatus according to claim 4, wherein the belt is an intermediate transfer member configured to convey secondarily transfer the toner image, which has been primarily transferred from an image bearing member, on to the recording material in the transfer portion.

* * * * *